US011209136B2

(12) United States Patent
Yotsumoto et al.

(10) Patent No.: US 11,209,136 B2
(45) Date of Patent: Dec. 28, 2021

(54) BUILT-IN ILLUMINATION APPARATUS AND LIGHT SOURCE UNIT

(71) Applicant: SONY CORPORATION, Tokyo (JP)

(72) Inventors: Naoki Yotsumoto, Tokyo (JP); Takashi Sato, Tokyo (JP); Hiroshi Hiraiwa, Aichi (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/615,178

(22) PCT Filed: May 25, 2018

(86) PCT No.: PCT/JP2018/020139

§ 371 (c)(1),
(2) Date: Nov. 20, 2019

(87) PCT Pub. No.: WO2019/008938

PCT Pub. Date: Jan. 10, 2019

(65) Prior Publication Data

US 2020/0224838 A1 Jul. 16, 2020

(30) Foreign Application Priority Data

Jul. 4, 2017 (JP) ..... JP2017-131176

(51) Int. Cl.

| | |
|---|---|
| ***F21S 8/02*** | (2006.01) |
| ***F21V 29/507*** | (2015.01) |
| ***F21V 29/70*** | (2015.01) |

(52) U.S. Cl.
CPC ..... *F21S 8/026* (2013.01); *F21V 29/507* (2015.01); *F21V 29/70* (2015.01)

(58) Field of Classification Search
CPC ..... F21S 8/026; F21V 29/507; F21V 29/70
See application file for complete search history.

(56) References Cited

U.S. PATENT DOCUMENTS 4,388,674 A * 6/1983 Sano ..... F21S 9/02 362/186
6,036,522 A * 3/2000 Holzer ..... F21V 19/0005 439/306

(Continued)

FOREIGN PATENT DOCUMENTS

CA 2765816 A1 12/2010
CN 102460008 A 5/2012

(Continued)

OTHER PUBLICATIONS

International Search Report and Written Opinion of PCT Application No. PCT/JP2018/020139, dated Jul. 17, 2018, 12 pages of ISRWO.

*Primary Examiner* — Bryon T Gyllstrom
*Assistant Examiner* — Christopher E Dunay
(74) *Attorney, Agent, or Firm* — Chip Law Group

(57) ABSTRACT

A built-in illumination apparatus according to the present technology includes a light fixture unit and a light source unit. The light fixture unit includes an outer contour portion to be built in a wall portion including a ceiling, and a first fitting portion. The light source unit includes a light source section, an additional functional section, and a second fitting portion, the light source section emitting light for illumination, the additional functional section having an additional function other than the illumination, the second fitting portion detachably fitting with the first fitting portion, the light source unit being disposed in the outer contour portion by the fitting.

17 Claims, 18 Drawing Sheets

(56) References Cited

U.S. PATENT DOCUMENTS

| | | | | |
|---|---|---|---|---|
| 2007/0064433 | A1* | 3/2007 | Wright | F21V 33/0056 362/364 |
| 2009/0284958 | A1* | 11/2009 | Pickard | F21S 8/026 362/147 |
| 2012/0106177 | A1* | 5/2012 | Blankestijn | F21V 19/001 362/382 |
| 2012/0127731 | A1* | 5/2012 | Masuda | F21V 29/85 362/341 |
| 2012/0127740 | A1* | 5/2012 | Masuda | F21V 23/002 362/373 |
| 2013/0286669 | A1* | 10/2013 | Moser | F21V 17/16 362/382 |
| 2014/0119034 | A1* | 5/2014 | Chen | F21K 9/238 362/373 |
| 2014/0204594 | A1 | 7/2014 | Kanazawa et al. | |
| 2014/0286022 | A1 | 9/2014 | Kimiya et al. | |

FOREIGN PATENT DOCUMENTS

| | | | |
|---|---|---|---|
| CN | 203453877 | U | 2/2014 |
| CN | 103939761 | A | 7/2014 |
| CN | 204227115 | U | 3/2015 |
| EP | 2443387 | A1 | 4/2012 |
| EP | 2757308 | A1 | 7/2014 |
| EP | 2781822 | A1 | 9/2014 |
| JP | 2010-129489 | A | 6/2010 |
| JP | 2012-530341 | A | 11/2012 |
| JP | 2012-530343 | A | 11/2012 |
| JP | 2014-053180 | A | 3/2014 |
| JP | 2014-143024 | A | 8/2014 |
| JP | 2014-186838 | A | 10/2014 |
| JP | 2014-220162 | A | 11/2014 |
| JP | 2015-153685 | A | 8/2015 |
| KR | 10-2012-0037475 | A | 4/2012 |
| WO | 2010/146509 | A1 | 12/2010 |

* cited by examiner

BUILT-IN ILLUMINATION APPARATUS AND LIGHT SOURCE UNIT

CROSS REFERENCE TO RELATED APPLICATIONS

This application is a U.S. National Phase of International Patent Application No. PCT/JP2018/020139 filed on May 25, 2018, which claims priority benefit of Japanese Patent Application No. JP 2017-131176 filed in the Japan Patent Office on Jul. 4, 2017. Each of the above-referenced applications is hereby incorporated herein by reference in its entirety.

Technical Field

The present technology relates to a built-in illumination apparatus and a light source unit used in the built-in illumination apparatus.

Background Art

A downlight to be built and installed in a ceiling has been widely known from the past as a type of lighting equipment. The existing downlights were mainly products to be used by attaching a lamp such as an incandescent bulb to a light fixture built in the top, i.e., the light fixture and the lamp exist separately from each other. Meanwhile, in recent years, from the viewpoint of energy saving, long life, and the like, an LED (Light Emitting Diode) has cove to be used as a light source of a lamp and is rapidly spreading.

The replacement frequency of the LED is less than that of the incandescent bulb because of the characteristic of the LED, i.e., long life. For this reason, LED downlights in which a light source part cannot be detached from the light fixture and the light fixture and the lamp are integrally formed have come to be widely used.

However, installation and replacement of the downlight is a work that requires the qualification of an electrician, which has caused a problem that the light source part cannot be easily replaced even in the case where a user desires to change the color, brightness, light distribution angle, and the like of the LED downlight once installed to occur.

For this reason, in recent years, downlight including a lamp configured to be attachable/detachable to/from the light fixture although it is an LED light source, have appeared (see, for example, Patent Literature 1).

Meanwhile, in recent years, among lamps (bulbs) used in hanging lighting equipment (which is not a downlight), lamps with functions other than lighting, such as an acoustic function by a speaker, have are becoming known (see, for example, Patent Literature 2).

Citation List

Patent Literature

Patent Literature 1: Japanese Patent Application Laid-open No. 2010-129489

Patent Literature 2: Japanese Patent Application Laid-open No. 2014-53180

DISCLOSURE OF INVENTION

Technical Problem

It has been known that in the lighting equipment such as hanging lighting equipment, a lamp attachable/detachable to/from a light fixture has an additional function other than lighting. However, it is not known that in the downlight, a lamp attachable/detachable to/from a light fixture has an additional function.

In view of the circumstances as described above, it is an object of the present technology to provide a technology such as a built-in illumination apparatus in which a light source unit attachable/detachable to/from a light fixture unit has an additional function other than lighting.

Solution to Problem

A built-in illumination apparatus according to the present technology includes: a light fixture unit; and a light source unit.

The light fixture unit includes an outer contour portion to be built in a wall portion including a ceiling, and a first fitting portion.

The light source unit includes a light source section, an additional functional section, and a second fitting portion, the light source section emitting light for illumination, the additional functional section having an additional function other than the illumination, the second fitting portion detachably fitting with the first fitting portion, the light source unit being disposed in the outer contour portion by the fitting.

As a result, it is possible to provide a built-in illumination apparatus in which a light source unit attachable/detachable to/from a light fixture unit has an additional function other than lighting.

In the built-in illumination apparatus, the second fitting portion may include a blade portion that detachably fits with the first fitting portion.

In the built-in illumination apparatus, the second fitting portion may further include a fitting portion body having a side peripheral surface, and the blade portion may be provided on the side peripheral surface of the fitting portion body.

In the built-in illumination apparatus, the light fixture unit may further include a guide that guides the blade portion to the first fitting portion.

In the built-in illumination apparatus, the guide may include a first guide and a second guide, the first guide guiding movement of the blade portion based on movement of the light source unit, the second guide guiding rotation of the blade portion based on rotation of the light source unit, the second guide being connected to the first guide and the first fitting portion.

In the built-in illumination apparatus, the light source unit may be moved in an insertion direction and inserted in the outer contour portion, and the second guide may guide the blade portion from the first guide to the first fitting portion in accordance with rotation of the light source unit in a first rotation direction, and include an inclined portion at a position connected to the first guide, the inclined portion being inclined toward the insertion direction in the first rotation direction.

In the built-in illumination apparatus, the light source unit may be moved in an insertion direction and inserted in the outer contour portion, the second guide may guide the blade portion from the first fitting portion to the first guide in accordance with rotation of the light source unit in a second rotation direction, the first fitting portion may include a bottom portion inclined toward the insertion direction in the second rotation direction, and the blade portion may have a facing surface that faces the bottom portion when fitting with the first fitting portion, the facing surface being inclined toward the insertion direction in the second rotation direction.

In the built-in illumination apparatus, the light fixture unit may further include a first terminal, and the light source unit may further include a second terminal that is to be electrically connected to the first terminal in accordance with fitting of the second fitting portion with the first fitting portion.

In the built-in illumination apparatus, at least one of the first terminal or the second terminal may include a leaf spring.

In the built-in illumination apparatus, the light source unit may include a casing having a side peripheral surface, and the second terminal may be provided on the side peripheral surface.

In the built-in illumination apparatus, the second fitting portion may be thermally connected to the outer contour portion in accordance with fitting with the first fitting portion.

In the built-in illumination apparatus, the outer contour portion may further include a projection portion that projects toward a side of the second fitting portion, the projection portion being thermally connected to the second fitting portion.

In the built-in illumination apparatus, the light source unit may further include a heat transfer portion that transfers, to the second fitting portion, heat from a heat source including the light source section.

In the built-in illumination apparatus, the heat source may include a first heat source including the light source section, and a second heat source including a heat source other than the light source section, and the heat transfer portion may include a first heat transfer portion and a second heat transfer portion, the first heat transfer portion transferring heat of the first heat source to the second fitting portion, the second heat transfer portion transferring heat of the second heat source to the second fitting portion.

In the built-in illumination apparatus, the second fitting portion may include a first fitting member and a second fitting member separated from the first fitting member, heat from the first heat transfer portion being transferred to the first fitting member, heat from the second heat transfer portion being transferred to the second fitting member.

A light source unit according to the present technology is a light source unit attachable/detachable to/from a light fixture unit that includes an outer contour portion to be built in a wall portion including a ceiling, and a first fitting portion, including: a light source unit that includes a light source section; an additional functional section; and a second fitting portion, the light source section emitting light for illumination, the additional functional section having an additional function other than the illumination, the second fitting portion detachably fitting with the first fitting portion, the light source unit being disposed in the outer contour portion by the fitting.

Advantageous Effects of Invention

As described above, in accordance with the present technology, it is possible to provide a technology such as a built-in illumination apparatus in which a light source unit attachable/detachable to/from a light fixture unit has an additional function other than lighting.

MODE(S) FOR CARRYING OUT THE INVENTION

Hereinafter, embodiments according to the present technology will be described with reference to the drawings.

First Embodiment

<Entire Configuration of Downlight 100 and Configuration of Respective Sections>

Figure 1:
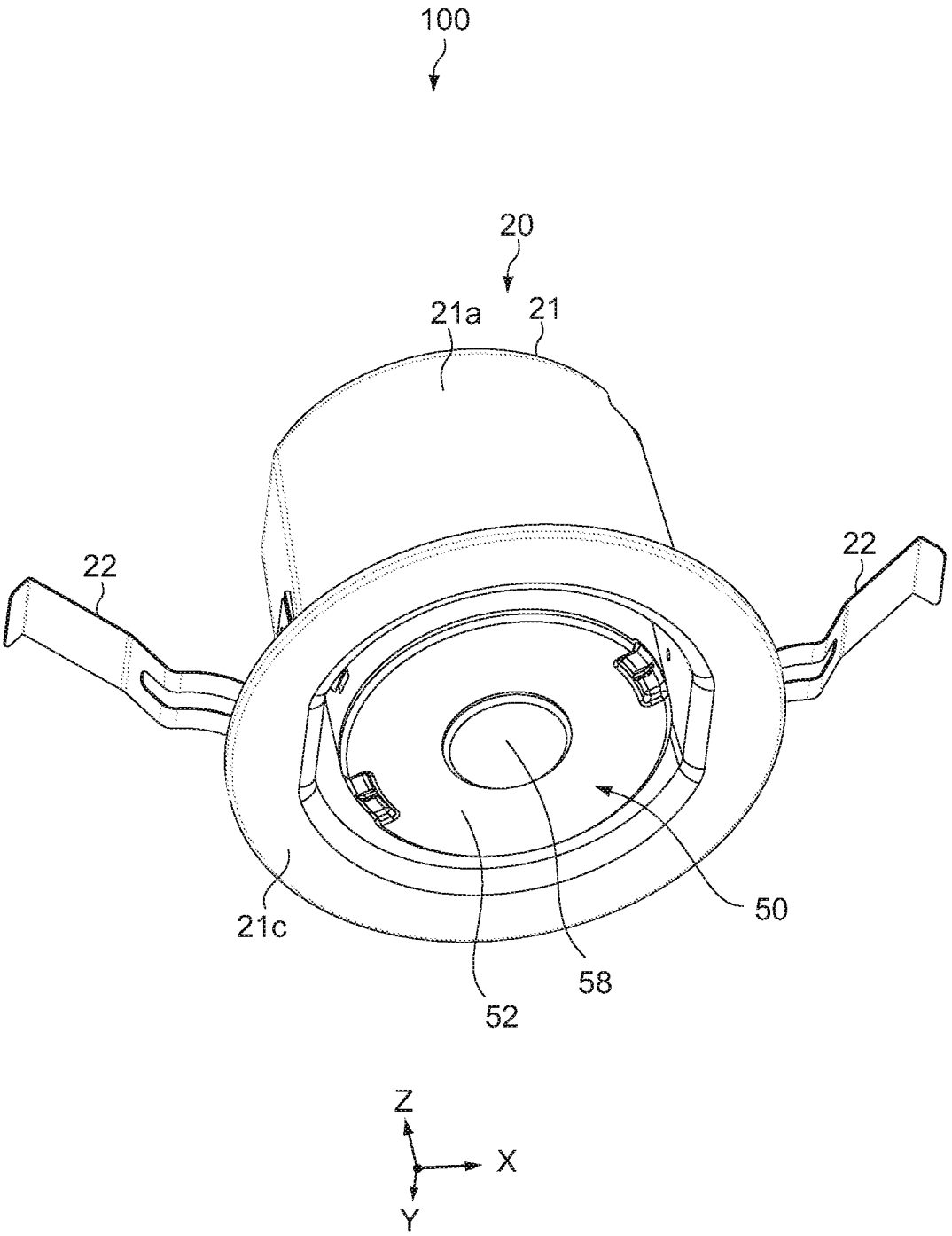
FIG. 1 is a perspective view of a downlight according to a first embodiment as viewed from below.
Figure 2:
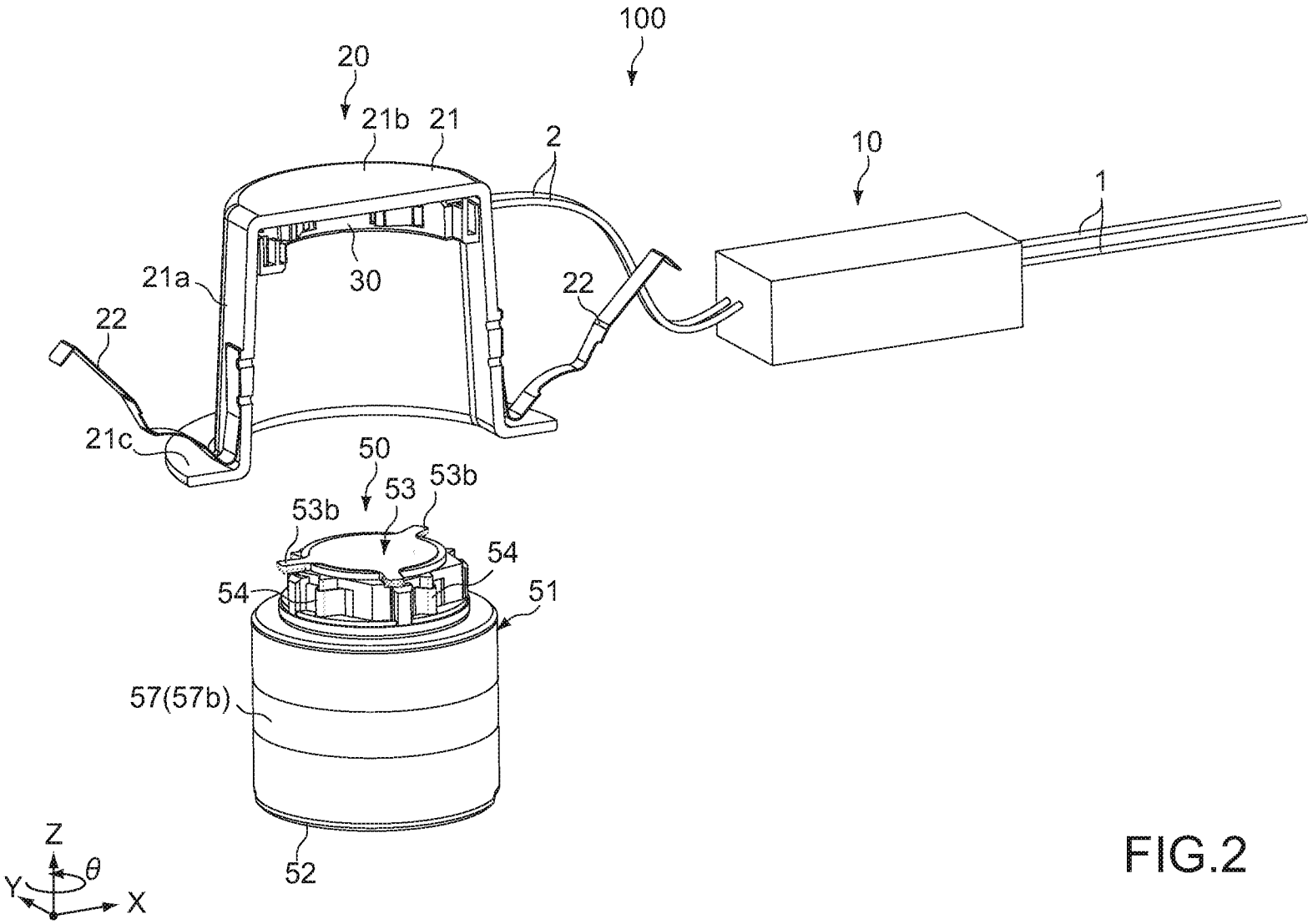
FIG. 2 is a perspective view of the downlight according to the first embodiment as viewed from above.

FIG. 1 is a perspective view of a downlight 100 according to a first embodiment of the present technology as viewed from below. FIG. 2 is a perspective view of the downlight 100 as viewed from above.

The downlight 100 (built-in illumination apparatus) according to the first embodiment is a type of lighting equipment, which is used by being built in a ceiling, and includes a power source unit 10, a light fixture unit 20, and a light source unit 50, as shown in FIG. 1 and FIG. 2.

[Power Source Unit 10]

The power source unit 10 is disposed behind the ceiling, and electrically connected to a wiring 1 for a commercial power source routed behind the ceiling. The power source unit 10 converts (insulation processing) an AC voltage from the commercial power source into a DC voltage (constant voltage), and supplies the DC voltage to the light source unit 50 via the light fixture unit 20. Note that although the case where the power source unit 10 and the light fixture unit 20 are separate is shown in the example shown in FIG. 2, the power source unit 10 and the light fixture unit 20 may be integrally formed.

[Light Fixture Unit 20]

The light fixture unit 20 is inserted from below into a built-in hole provided in the ceiling and attached to the ceiling. The light fixture unit 20 includes an outer contour portion 21 to be built in the ceiling, attachment springs 22 for attaching the outer contour portion 21 to the ceiling, and a socket portion 30 fixed to the upper side inside the outer contour portion 21.

The outer contour portion 21 is formed of a metal material, and formed in a cylindrical shape having a lid portion 21*b*. The outer contour portion 21 includes a cylindrical portion 21*a* formed to have a diameter that gradually increases toward the lower side, the lid portion 21*b* that closes the upper side of the cylindrical portion 21*a*, and a flange portion 21*c* provided on the lower side of the cylindrical portion 21*a*. In the outer contour portion 21, a space surrounded by the lower surface of the lid portion 21*b* and the inner peripheral surface of and the cylindrical portion 21*a* forms a space into which the light source unit 50 is to be inserted.

The attachment springs 22 are formed symmetrically on the outer peripheral surface of the outer contour portion 21 one by one at symmetrical positions. The attachment springs 22 are each configured in such a way that a plate-like metal plate long in one direction is bent, and fix the light fixture unit 20 to the ceiling by the urging force.

Figure 3:
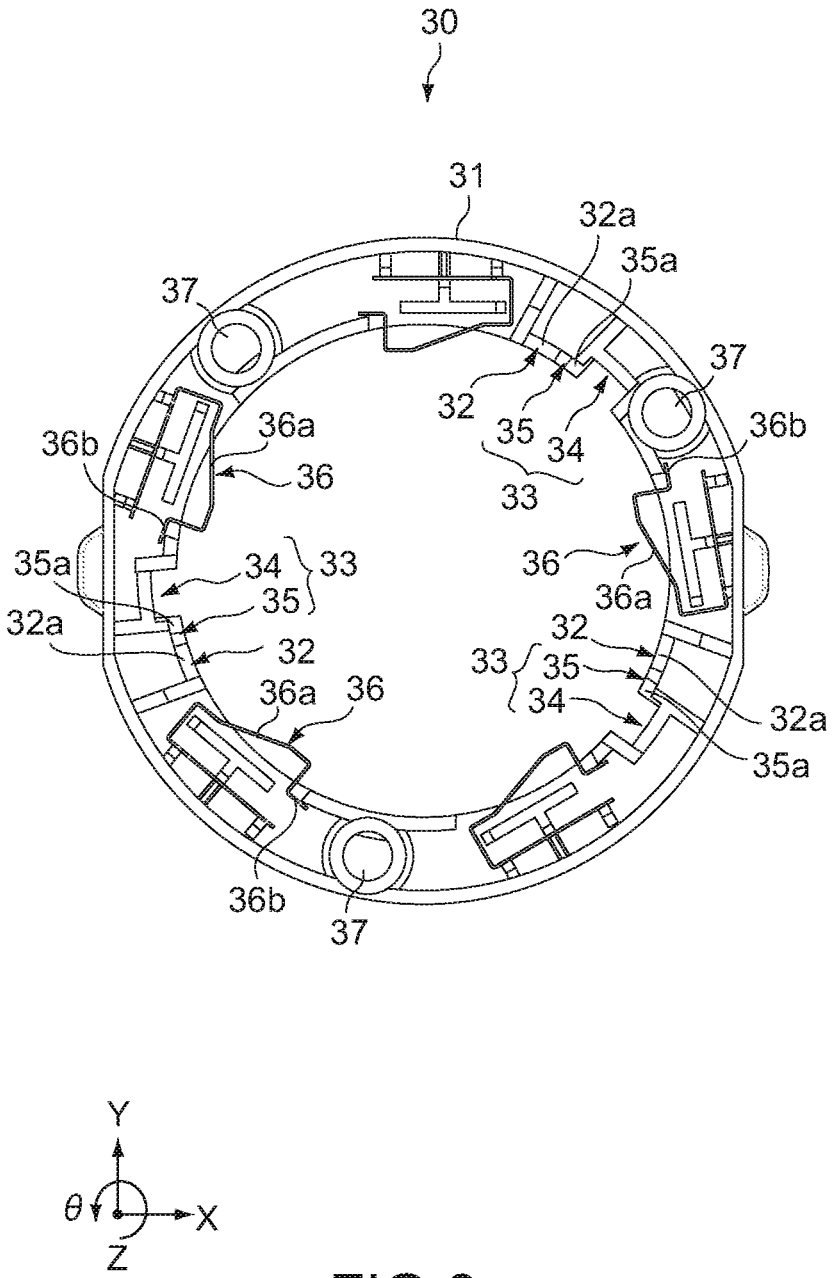
FIG. 3 is a view of a socket portion as viewed from above.
Figure 4:
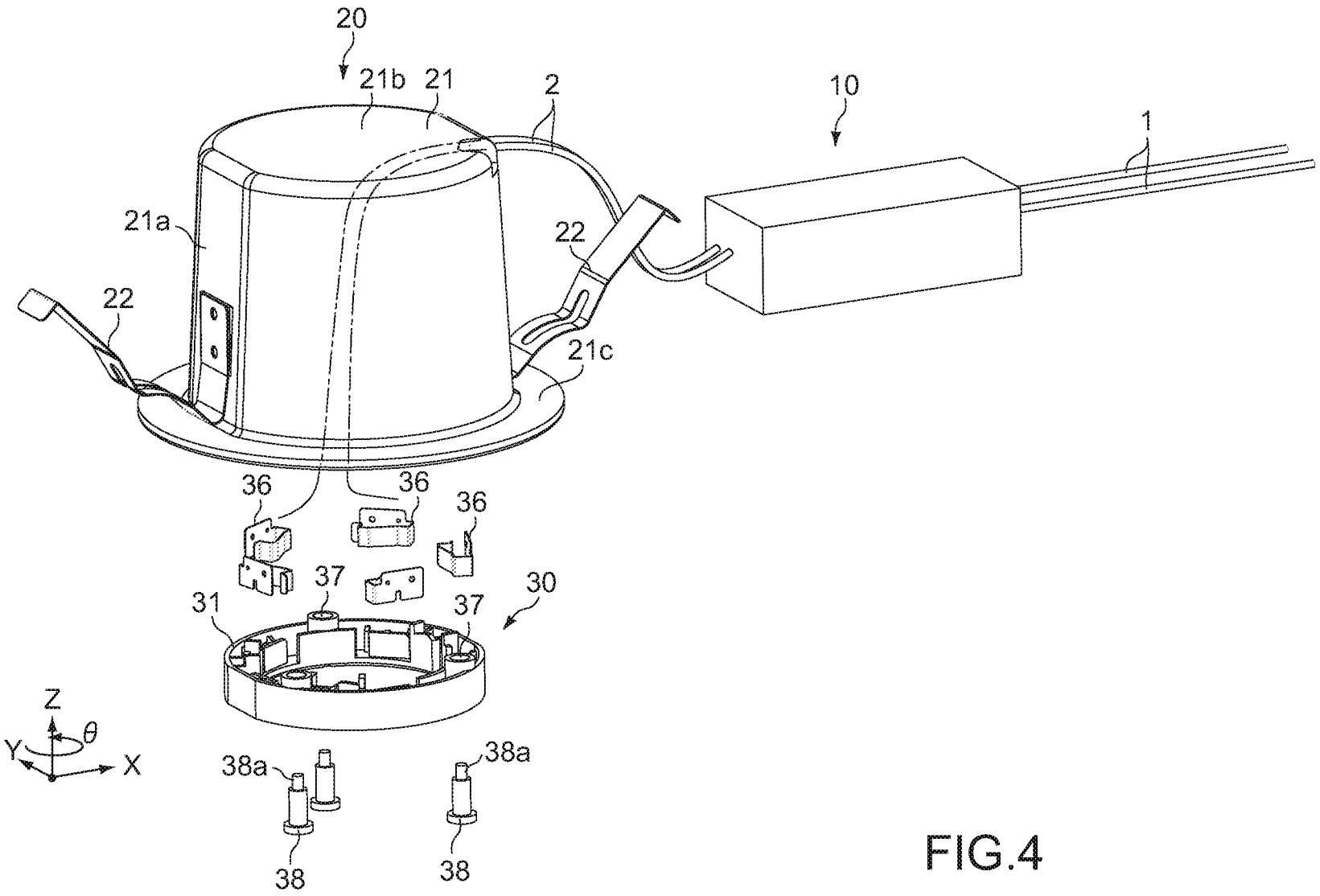
FIG. 4 is an exploded perspective view showing the state when the socket portion is detached from a light fixture unit.

FIG. 3 is a view of the socket portion 30 as viewed from above. FIG. 4 is an exploded perspective view showing the state when the socket portion 30 is detached from the light fixture unit 20.

As shown in the figures, the socket portion 30 includes an annular socket portion body 31, first fitting portions 32 provided in the socket portion body 31, guides 33, and first terminals 36.

The socket portion body 31 includes three insertion holes 37 through which three guide pins 38 are inserted. The three insertion holes 37 pass through the socket portion body 31 in the vertical direction (Z-axis direction), and are arranged at equal intervals (120° intervals) in the circumferential direction (θdirection). In the lid portion 21*b* of the outer contour portion 21, three screw holes (not shown) are formed at positions (120° intervals) corresponding to the three insertion holes 37.

The guide pins 38 each include a screw portion 38*a* at the tip thereof, which is to be screwed into the screw hole. The guide pins 38 are each inserted into the insertion holes 37 from below the socket portion body 31, and then, the screw portion 38*a* provided on the side of the tip of the guide pin 38 is screwed into the screw hole provided in the lid portion 21*b* of the outer contour portion 21. As a result, the socket portion 30 is fixed to the outer contour portion 21.

The socket portion body 31 is a member to which the first terminals 36 are attached, and is a member that detachably holds the light source unit 50. For this reason, the socket portion body 31 is formed of an insulator material having a certain strength. Examples of the material forming the socket portion body 31 include resins such as ABS (Acrylonitrile Butadiene Styrene), PBT (Polybutylene Terephthalate), and PC (Polycarbonate).

In this embodiment, the number of the first terminals 36 is five. The five first terminals 36 are arranged at equal intervals (72°) along the circumferential direction in the socket portion body 31. One first terminal 36 of the five first terminals 36 is electrically connected to a positive wiring of two the wirings 2 drawn from the power source unit 10 (i.e., this first terminal is a positive terminal). Further, other one of the five first terminals 36 is electrically connected to a negative wiring of the two wirings 2 drawn from the power source unit 10 (i.e., this first terminal 36 is a ground terminal).

Of the five first terminals 36, the three first terminals 36 other than the positive terminal and the ground terminal can be used for various purposes. For example, the first terminal 36 may be used as a terminal for light adjustment or toning to which a signal line from a provided device for light adjustment or toning is connected. Further, the first terminal 36 may be used as a power failure terminal to be connected to a signal line for notifying that a power failure has been detected (In this case, the downlight 100 is used as an emergency light).

Note that it only needs to provide at least two first terminals 36, i.e., the positive terminal and the ground terminal, and the other three first terminals 36 may be omitted.

The first terminals 36 are each configured in such a way that a plate-like metal member long in one direction is bent, and is formed in a leaf spring shape. One end of the first terminal 36 is a fixed end fixed to the socket portion 30, and the other end is a free end that is not fixed to the socket portion 30.

In the first terminal 36, the free end side is urged toward the inside in the radial direction by its own urging force due to the leaf spring shape. A claw portion 36*b* is provided at the end portion on the free end side, and the claw portion 36*b* is hung on the socket portion body 31, thereby positioning the free end side.

Further, in the first terminal 36, a part on the free end side projects to the inside in the radial direction relative to the inner peripheral surface of the socket portion body 31. The first terminal 36 includes an inclined portion 36*a* at the projecting part. The inclination of the inclined portion 36*a* is set so as to gradually project toward the inside in the radial direction in the counterclockwise direction (direction in which the light source unit 50 is rotated when the light source unit 50 is attached to the light fixture unit 20).

Examples of the material used for the first terminal 36 include brass with nickel plating on the surface thereof and copper with gold plating on the surface thereof.

The first fitting portions 32 in the light fixture unit 20 are a mechanism for causing blade portions 53*b* (described in detail below) of a second fitting portion 53 in the light source unit 50 to mechanically fit with the light fixture unit 20. Further, the guides 33 are a mechanism for guiding the blade portions 53*b* to the first fitting portions 32.

Figure 5:
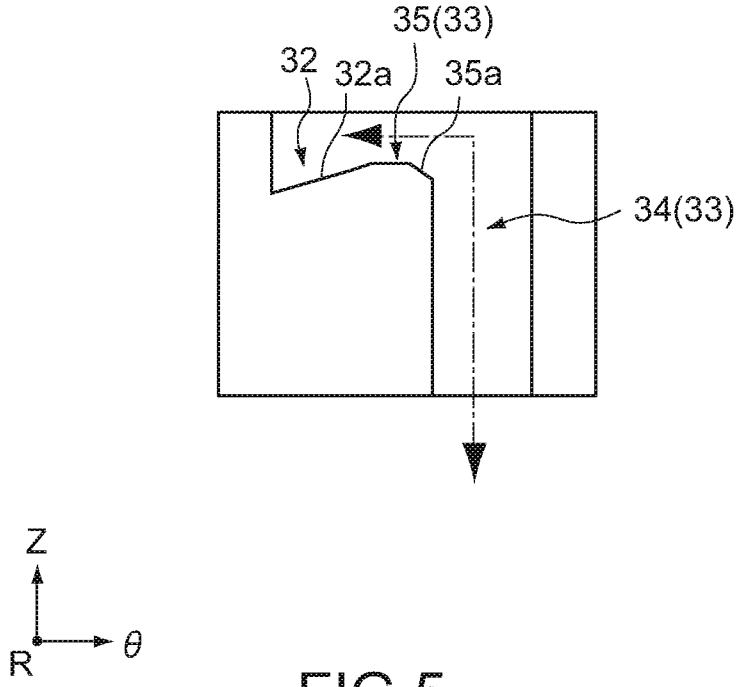
FIG. 5 is a schematic diagram of a first fitting portion and a guide in the light fixture unit as viewed from the inside in the radial direction.

FIG. 5 is a schematic diagram showing the first fitting portions 32 and the guides 33 in the light fixture unit 20 as viewed from the inside in the radial direction. Note that a dot-dash line in FIG. 5 indicates a path along which the blade portions 53*b* (to be described below) in the second fitting portion 53 of the light source unit 50 moves in the guides 33.

Referring to FIG. 3 and FIG. 5, three first fitting portions 32 and three guides 33 are provided at equal intervals (120° intervals) in the circumferential direction (θdirection). Note that the number of the first fitting portions 32, the number of the guides 33, and the positions thereof in the circumferential direction correspond to the number and position of the blade portions 53*b* of the light source unit 50.

The guides 33 each include a first guide 34 that guides the vertical movement of the blade portion 53*b* based on the vertical movement of the light source unit 50, and a second guide 35 that guides rotation of the blade portion 53*b* based on rotation of the light source unit 50.

The first guide 34 is formed on the inner peripheral surface of the socket portion body 31 so as to be recessed (i.e., in a groove shape) toward the outside in the radial direction along the vertical direction (Z-axis direction). Further, the first guide 34 has a shape (in the XY direction) similar to the tip side of the blade portion 53*b* of the light source unit 50, and has a size (in the XY direction) slightly larger than the blade portions 53*b*.

The second guide 35 is capable of guiding the blade portion 53*b* from the first guide 34 to the first fitting portion 32 in accordance with the rotation of the light source unit 50 in the counterclockwise (first rotation direction: rotation direction when the light source unit 50 is attached). Further, the second guide 35 is capable of guiding the blade portion 53*b* from the first fitting portion 32 to the first guide 34 in accordance with the rotation of the light source unit 50 in the clockwise direction (second rotation direction: rotation direction when the light source unit 50 is detached).

The second guides 35 are each connected to the upper portion of the first guide 34 and the first fitting portion 32, and are arranged at counterclockwise positions in the circumferential direction relative to the first guide 34. The width of the second guide 35 in the vertical direction is slightly larger than the thickness (in the Z-axis direction) of the blade portion 53*b*. Further, the second guide 35 includes an inclined portion 35*a* at a lower position of the position connected to the first guide 34, which is inclined toward the upper side (insertion direction: direction in which the light source unit 50 is inserted into the outer contour portion 21) in the counterclockwise direction (first rotation direction) in the circumferential direction.

The first fitting portion 32 is formed at an upper position on the side of the inner peripheral surface of the socket portion body 31 so as to be recessed downward (i.e., in a groove shape). Note that the first fitting portions 32 are arranged at positions above the positions at which the first terminals 36 are arranged.

The first fitting portion 32 is formed at a counterclockwise position in the circumferential direction relative to the second guide 35 so as to be connected to the second guide 35. Further, the first fitting portion 32 is provided at a position of approximately 15° counterclockwise from the position of the first guide 34. Note that a bottom portion 32*a* of the first fitting portion 32 is formed so as to be inclined upward (insertion direction) in the clockwise direction (second rotation direction) in the circumferential direction.

Although the second guide 35 and the first fitting portion 32 are formed at counterclockwise positions in the circumferential direction relative to the first guide 34 in this embodiment, the second guide 35 and the first fitting portion 32 may be formed clockwise positions relative to the first guide 34.

[Light Source Unit 50]

Figure 6:
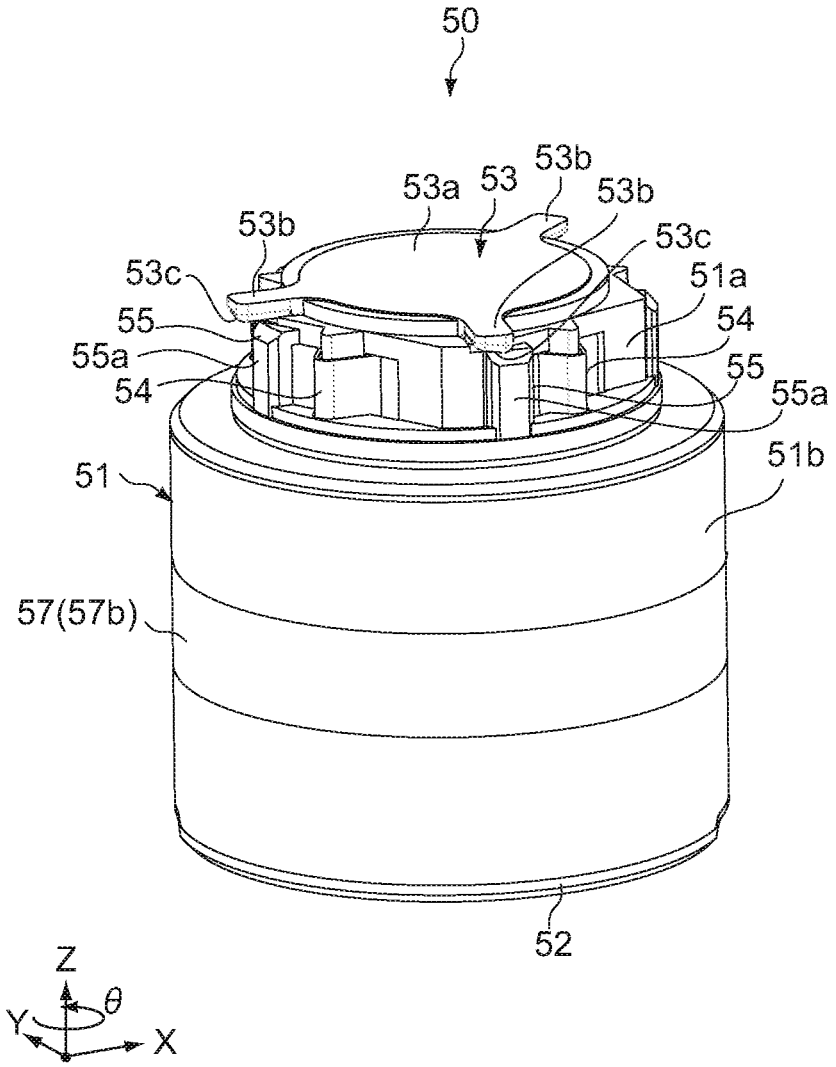
FIG. 6 is an enlarged view showing the light source unit.
Figure 7:
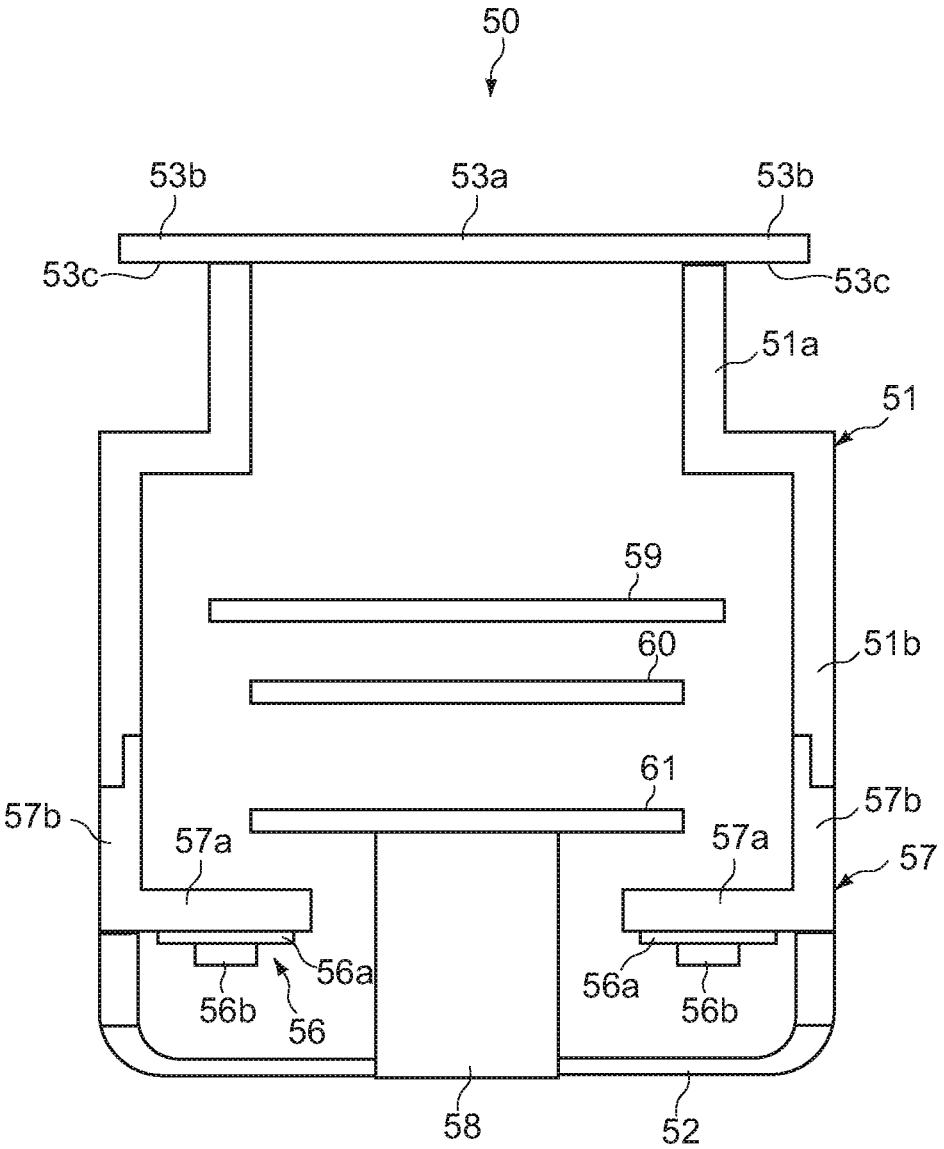
FIG. 7 is a schematic side cross-sectional view showing the internal structure of the light source unit.
Figure 7:
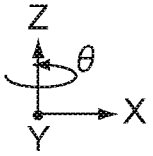

FIG. 6 is an enlarged view showing the light source unit 50. FIG. 7 is a schematic side cross-sectional view showing the internal structure of the light source unit 50.

As shown in FIG. 6 and FIG. 7, the light source unit 50 includes a casing 51, a transparent cover member 52, the second fitting portions 53, second terminals 54, contact portions 55, a light source section 56, a heat sink 57, an additional functional section 58, a light source control substrate 59, a functional section control substrate 60, and a wireless communication substrate 61.

The casing 51 has a cylindrical shape, and the upper diameter is smaller than the lower diameter. Note that in the following description, in the case of distinguishing a part having a smaller diameter and a part having a larger diameter in the casing 51 from each other, the part having a small diameter in the upper portion of the casing 51 will be referred to as a small diameter portion 51*a*, and the part having a large diameter in the lower portion of the casing 51 will be referred to as a large diameter portion 51*b*.

In the upper portion of the small diameter portion 51*a* of the casing 51, the second fitting portions 53 that fit with the first fitting portions 32 are provided. Further, on the side peripheral surface of the small diameter portion 51*a* of the casing 51, the second terminals 54 to be electrically connected to the first terminals 36 and the contact portions 55 to be in contact with the inner peripheral surface of the socket portion body 31 are provided. Meanwhile, on the lower side of the large diameter portion 51*b* of the casing 51, the transparent cover member 52 is provided.

The height (including the height of the second fitting portion 53) of the small diameter portion 51*a* of the casing 51 is approximately the same as that of the socket portion 30 or slightly larger than that of the socket portion 30. Further, the diameter of the small diameter portion 51*a* of the casing 51 is slightly smaller than the inner diameter of the socket portion 30.

Meanwhile, the diameter of the large diameter portion 51*b* of the casing 51 is slightly smaller than the inner diameter of the cylindrical portion 21*a* in the outer contour portion 21. Further, the height of the entire casing 51 (the height of the entire light source unit 50) is approximately the same as that of the space inside the outer contour portion 21 or slightly smaller than the height of the space.

In this embodiment, when the light source unit 50 is attached to the light fixture unit 20, the height position of the lower surface (transparent cover member 52) of the light source unit 50 substantially corresponds to the height position of the lower surface of the flange portion 21*c* in the outer contour portion 21. Note that the size of the casing 51 may be any size as long as the casing 51 can be housed inside the outer contour portion 21.

As the material used for the casing 51, typically, the same material (e.g., a resin such as ABS, PBT, and PC) as that used for the socket portion body 31 in the light fixture unit 20 is used (in particular, a part entering the socket portion 30: the small diameter portion 51*a* of the casing 51). Note that in the case where a material different from that of the socket portion body 31 is used as the material of the casing 51, there is a possibility that the fitting property between the socket portion 30 and the light source unit 50 is deteriorated by deviation of contraction and expansion due to the difference in linear expansion coefficient.

The heat sink 57 that releases heat from the light source section 56 to the outside and is formed of a metal material is exposed and disposed at a position near the center of the large diameter portion 51*b* of the casing 51 in the vertical direction. A part of the heat sink 57 constitutes a part of the casing 51. That is, the casing 51 is partially formed of metal. The heat sink 57 includes a light source holding portion 57*a* that holds the light source section 56 and a wall portion 57*b* that constitutes a part of the casing 51.

The light source holding portion 57*a* is configured by forming a plate-like member thin in the thickness direction (in the Z-axis direction) to have an annular shape, and the light source section 56 is attached to the lower side thereof. The wall portion 57*b* is a member having a cylindrical shape, and provided on the light source holding portion 57*a* so as to be erected upward on the outer peripheral side of the light source holding portion 57*a*.

The second fitting portion 53 includes a plate-like member formed of a metal material. Note that the second fitting portion 53 may be formed of a resin material as long as a certain level or more of strength can be secured. Further, the second fitting portion 53 may be formed of the same material as that of the casing 51. In this case, the second fitting portion 53 may be integrally formed with the casing 51.

The second fitting portion 53 includes a fitting portion body 53*a* formed to have a disc-like shape, and the three blade portions 53*b* formed to project outward in the radial direction from the side peripheral surface of the fitting portion body 53*a*. The three blade portions 53*b* are arranged at equal intervals (120°) in the circumferential direction. Note that the number of the blade portions 53*b* only needs to be at least two, and the number of the blade portions 53*b* is not particularly limited (however, when the number of the blade portions 53*b* is changed, also the number of the first fitting portions 32 and the number of the guides 33 are changed).

The blade portions 53*b* are each configured to be able to be guided along the first guide 34 and the second guide 35 of the socket portion 30. Further, the blade portions 53*b* are configured to be capable of fitting with the first fitting portions 32. The upper surface of the blade portion 53*b* is a flat surface, but a lower surface 53*c* (facing surface: surface facing the bottom portion 32*a* when fitting with the first fitting portion 32) is formed to be inclined upward (insertion direction) in the clockwise direction (second rotation direction). That is, the lower surface 53*c* of the blade portion 53*b* is formed so as to be inclined upward in the clockwise direction in the circumferential direction similarly to the bottom portion 32*a* of the first fitting portions 32 so that the lower surface 53*c* can be appropriately fitted with the first fitting portion 32.

In this embodiment, the light source unit 50 is configured to be mechanically attachable/detachable to/from the light fixture unit 20 (without requiring a tool such as a screwdriver) by the first fitting portions 32 and the guides 33 on the side of the light fixture unit 20, and the second fitting portions 53 on the side of the light source unit 50. Specifically, in this embodiment, the light source unit 50 is attachable/detachable to/from the light fixture unit 20 by the movement of the light source unit 50 in the vertical direction and the rotation thereof around the Z axis.

The second terminals 54 can be electrically connected to the first terminals 36 by the mechanical connection (fitting) of the first fitting portions 32 to the second fitting portions 53.

The second terminals 54 are each provided on the side peripheral surface of the small diameter portion 51*a* in the casing 51 so as to project outward in the radial direction from the side peripheral surface. The second terminal 54 is formed in a V shape as viewed from above. The second terminal 54 is fixed to the casing 51 so as not to move even when an external force is applied unlike the first terminal 36 formed in a leaf spring shape.

Note that both the first terminal 36 and the second terminal 54 may be formed in a leaf spring shape, or only the second terminal 54 may be formed in a leaf spring shape. Typically, at least one of the first terminal 36 and the second terminal 54 only needs to be formed in a leaf spring shape. Examples of the material used for the second terminal 54 include brass with nickel plating on the surface thereof and copper with gold plating on the surface thereof, similarly to the first terminals 36. Note that by performing the plating process on the first terminal 36 and the second terminal 54, it is possible to reduce deterioration of the contact property due to rust and oxide coating film generated by aging.

In this embodiment the number of the second terminals 54 is five, which is the same as the number of the first terminals 36. The five second terminals 54 are arranged at equal intervals (72°) in the circumferential direction on the side peripheral surface of the small diameter portion 51*a* of the casing 51.

Of the five second terminals 54, one second terminal 54 is a terminal to be electrically connected to the positive terminal of the first terminals 36, and other one second terminal 54 is a terminal to be electrically connected to the ground terminal of the first terminals 36. Of the five second terminals 54, the other three terminals can be used for various purposes similarly to the above-mentioned first terminals 36. Note that it only needs to provide at least two second terminals 54, and the other three second terminals 54 may be omitted.

The distance from the center of the light source unit 50 to the tip end portion (on the outer side in the radial direction) of the second terminal 54 is slightly smaller than the distance from the center of the socket portion body 31 to the inner peripheral surface of the socket portion body 31.

The contact portions 55 come into contact with the inner peripheral surface of the socket portion body 31 when the second fitting portions 53 in the light source unit 50 are attached to and detached from (vertically moved, rotated) the first fitting portions 32 in the light fixture unit 20 so that the second fitting portions 53 can be stably attached to and detached from (vertically moved, rotated) the first fitting portions 32.

The contact portion 55 is a columnar member long in the vertical direction, and provided in the casing 51 so as to project outward in the radial direction from the outer peripheral surface in the small diameter portion 51*a* of the casing 51. The contact portion 55 has a contact surface 55*a* at the tip end portion (on the outer side in the radial direction), which is to be in contact with the inner peripheral surface of the socket portion body 31. The position of the contact surface 55*a* in the contact portion 55 is set so that the contact surface 55*a* is located on the outer side in the radial direction relative to the tip end portion of the second terminal 54.

Note that the distance from the center of the light source unit 50 to the contact surface 55*a* in the contact portion 55 is slightly smaller than the distance from the center of the socket portion body 31 to the inner peripheral surface of the socket portion body 31.

In this embodiment the number of the contact portions 55 is five similarly to the number of the second terminals 54. The five contact portions 55 are arranged at equal intervals (72°) in the circumferential direction on the side peripheral surface of the small diameter portion 51*a* of the casing 51. Note that the number of the contact portions 55 is not particularly limited as long as it is typically two or more. Further, the number of the contact portions 55 may be different from that of the second terminals 54.

The position of the contact portion 55 is set so that the condition that the position does not interfere with the electrical connection between the first terminal 36 and the second terminal 54 at the time when they are electrically connected to each other and the condition that the contact portion 55 is not in contact with the first terminal 36 when the light source unit 50 is rotated are satisfied. Note that in this embodiment, the contact portions 55 are arranged at positions of approximately 15° clockwise in the circumferential direction relative to the second terminals 54. Meanwhile, the contact portion 55 may be located at any position as long as the above-mentioned conditions are satisfied.

The light source section 56 is disposed at a lower position inside the casing 51, and emits light downward. The light source section 56 includes an LED substrate 56*a* and a plurality of LED devices 56*b* provided on the LED substrate 56*a*. The LED substrate 56*a* is fixed to the lower surface of the light source holding portion 57*a* in the above-mentioned the heat sink 57. The LED substrate 56*a* is formed in an annular shape, and also the plurality of LED devices 56*b* is annularly arranged. Note that although, an LED is used as a light source in this embodiment, an organic EL (Electro Luminescence), a fluorescent lamp, or the like may be used as the light source.

The additional functional section 58 is disposed at the center position (XY direction) of the annular light source section 56 inside the casing 51. The additional functional section 58 is formed in, for example, a cylindrical shape, and disposed so that the lower surface thereof is exposed from the center of the transparent cover member 52.

The additional functional section 58 has an additional function, which is a function other than illumination. Examples of the additional functional section 58 having the additional function include a speaker having a sound output function, a projector having a projection function, a camera having an imaging function, and a microphone having a sound collection function. Further, examples of the additional functional section 58 having the additional function include various sensors such as a temperature sensor having a temperature detection function, a humidity sensor having a humidity detection function, a vibration sensor having a vibration detection function, and an optical sensor having a light detection function (e.g., an infrared sensor).

Typically, among the apparatuses such as the speaker, the projector, the camera, the microphone, and the various sensors described above, one apparatus is disposed inside the casing 51 as the additional functional section 58. However, two or more apparatuses may be disposed inside the casing 51.

In this embodiment, for example, assumption is made that various types of the light source unit 50 such as the light source unit 50 equipped with a speaker, the light source unit 50 equipped with a projector, and the light source unit 50 equipped with a camera are prepared.

Then, in the case where a user attaches the light source unit 50, the user selects the light source unit 50 including the desired additional functional section 58 among the various light source units 50, and attaches the light source unit 50 to the light fixture unit 20. Further, in the case where the user desires to replace the light source unit 50 that has already been installed with a different light source unit 50 including another additional functional section 58, the user detaches the light source unit 50 from the light fixture unit 20 and then attaches the different light source unit 50 to the light fixture unit 20.

Note that various types of light source unit 50 in which not only the additional functional section 58 differs but also the color, brightness, light distribution angle, and the like in the light source section 56 differ may be prepared. In this case, a user is capable of selecting not only the additional functional section 58 but also the color, brightness, light distribution angle, and the like by the light source section 56.

The light source control substrate 59, the functional section control substrate 60, and the wireless communication substrate 61 are arranged inside the casing 51 in the stated order from the top. These substrates are fixed to the inside of the casing 51 by supporting members (not shown). Note that the positions of the light source control substrate 59, the functional section control substrate 60, and the wireless communication substrate 61 inside the casing 51 can be appropriately changed.

[Electrical Configuration of Downlight 100]

Figure 8:
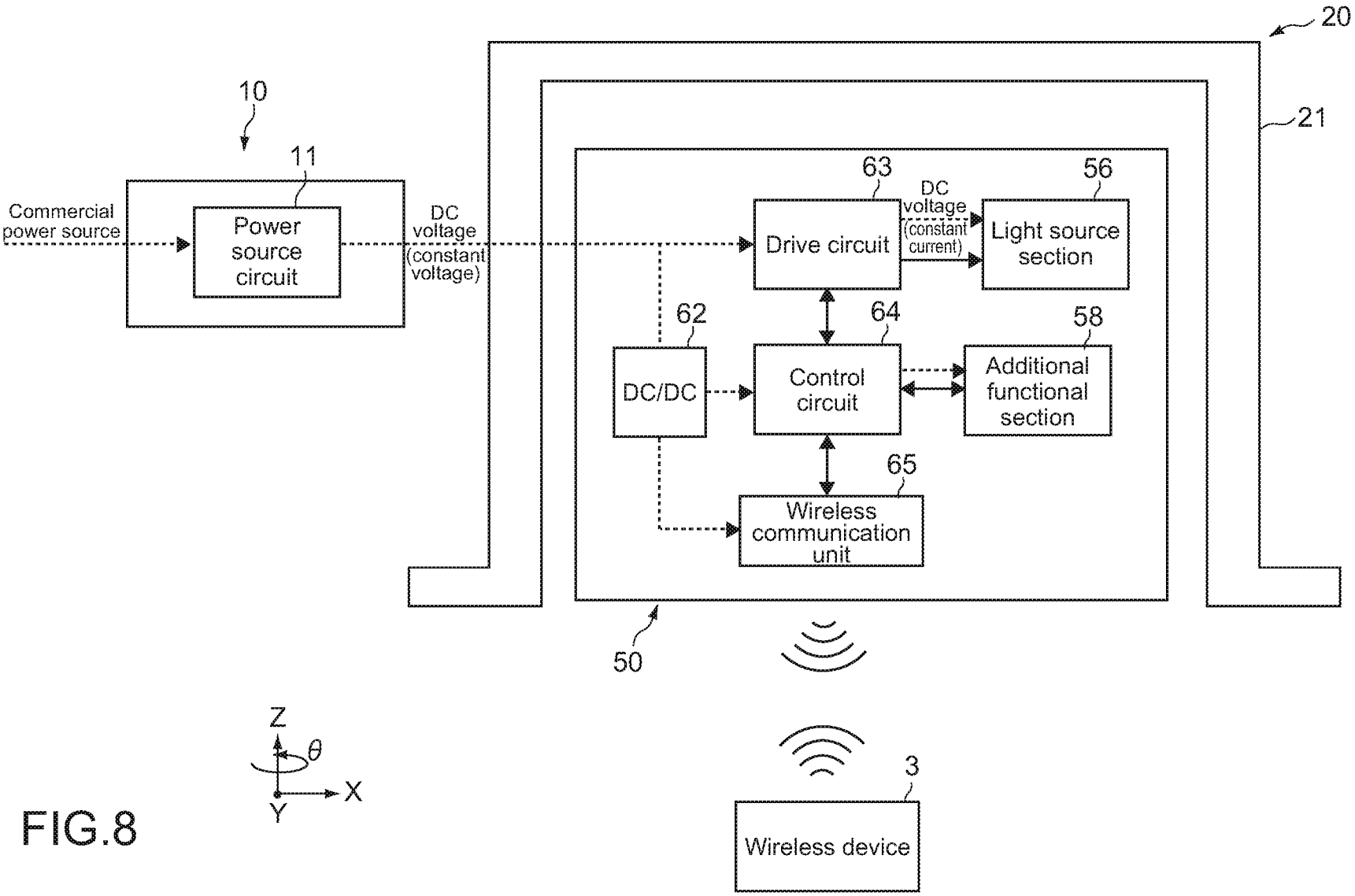
FIG. 8 is a block diagram showing an electrical configuration of a downlight.

Next, an electrical configuration of the downlight 100 will be described. FIG. 8 is a block diagram showing an electrical configuration of the downlight 100. In FIG. 8, transmission/reception of a signal in the respective sections is represented by a solid line, and power supply is represented by a broken line.

The light source unit 50 includes a DC/DC converter 62, a drive circuit 63, a control circuit 64, and a wireless communication unit 65 in addition to the light source section 56 and the additional functional section 58 described above. The drive circuit 63 is mounted on the light source control substrate 59, and the control circuit 64 is mounted on the functional section control substrate 60. Further, the wireless communication unit 65 is mounted on the wireless communication substrate 61.

The wireless communication unit 65 is configured to be capable of communicating with a wireless device 3 wirelessly. The wireless device 3 that performs wireless communication with the downlight 100 (light source unit 50) may be a general-purpose device such as a smartphone and a tablet PC (Personal Computer), or a dedicated device such as a remote controller. Typically, the wireless device 3 may be any device as long as it is a device capable of performing wireless communication with the downlight 100.

The wireless communication unit 65 receives, from the wireless device 3, information to be output from the additional functional section 58, such as sound and an image (moving image, still image), and outputs the received information to the control circuit 64. Further, the wireless communication unit 65 transmits, in accordance with an instruction from the control circuit 64, the information, which is acquired by the additional functional section 58, to the wireless device 3.

For example, in the case where the additional functional section 58 is a speaker or a projector, the wireless communication unit 65 receives information regarding sound or information regarding an image (moving image, still image) from the wireless device 3, and outputs the received information to the control circuit 64. Further, for example, in the case where the additional functional section 58 is various sensors such as a temperature sensor and a humidity sensor, a camera, or a microphone, the wireless communication unit 65 transmits, in accordance with an instruction from the control circuit 64, sensing information acquired by the various sensors, the information regarding an image (moving image, still image) acquired by the camera, or the information regarding sound acquired by the microphone to the wireless device 3.

Further, the wireless communication unit 65 receives, from the wireless device 3, information (e.g., information regarding ON/OFF of the light source section 56, information for light adjustment or toning) for controlling the light source section 56, and outputs the received information to the control circuit 64.

As a wireless communication method between the wireless communication unit 65 and the wireless device 3, various wireless communication methods such as Wi-Fi (Wireless Fidelity), Bluetooth (registered trademark), Zigbee, and a 920 MHz band wireless communication method are used.

Here, in this embodiment, it is necessary to carry information (information regarding sound, information regarding an image, sensing information, or the like) relating to an additional function in the additional functional section 58 through wireless communication. Meanwhile, although Zigbee and the 920 MHz band wireless communication method have a long communication distance and high stability, the amount of information that can be carried is small. For this reason, information for controlling the light source section 56, which has a small amount of information, can be carried by Zigbee and the 920 MHz band wireless communication method, but there is a possibility that information regarding an additional function, which has a large amount of information, cannot be carried. For this reason, typically, as the wireless communication method between the wireless communication unit 65 and the wireless device 3, Wi-Fi (Wireless Fidelity) or Bluetooth by which a large amount of information can be carried is used.

The drive circuit 63 controls driving of the light source section 56 in accordance with an instruction of the control circuit 64. For example, the drive circuit 63 executes processing of turning on/off the light source section 56 in accordance with a command to turn on/off the light source section 56 from the control circuit 64, and processing of adjusting the brightness or color of the light source section 56 in accordance with a command regarding light adjustment or toning from the control circuit 64.

The control circuit 64 executes processing of controlling the additional functional section 58, and processing of controlling the light source section 56 via the drive circuit 63. For example, in the case where the additional functional section 58 is a speaker or a projector, the control circuit 64 causes, on the basis of the information regarding sound received via the wireless communication unit 65, the speaker to output sound, and causes, on the basis of the information regarding an image (moving image, still image) received via the wireless communication unit 65, the projector to output an image. Further, for example, in the case where the additional functional section 58 is various sensors such as a temperature sensor and a humidity sensor, a camera, a microphone, or the like, the control circuit 64 transmits, to the wireless device 3 via the wireless communication unit 65, the sensing information acquired by the various sensors, the information regarding an image (moving image, still image) acquired by the camera, or the information regarding sound acquired by the microphone.

Further, the control circuit 64 outputs, in accordance with the information regarding ON/OFF of the light source section 56 received via the wireless communication unit 65, a command signal for turning on/off the light source section 56 to the drive circuit 63. Further, for example, the control circuit 64 outputs, in accordance with the information regarding light adjustment or toning received via the wireless communication unit 65, a command signal for light adjustment or toning to the drive circuit 63.

The power source unit 10 includes a power source circuit 11 therein. This power source circuit 11 converts (insulation processing) an AC voltage (e.g., AC100 to 120 V, AC200 to 240 V) by a commercial power source into a DC voltage (constant voltage: e.g., 12 V), and supplies the DC voltage to the first terminal 36 (positive terminal) of the light fixture unit 20. The DC voltage supplied to the first terminal 36 (positive terminal) is supplied into the light source unit 50 via the connection between the first terminal 36 (positive terminal) and the second terminal 54 (positive terminal).

Note that the ground side of the DC voltage is electrically connected to the outer contour portion 21 of the light fixture unit 20, and the outer contour portion 21 of the light fixture unit 20 is set to the same potential as the ground potential.

The DC/DC converter 62 converts the potential (e.g., 12 V) in the DC voltage supplied from the power source circuit 11 into a potential (e.g., 5 V) suitable for driving the control circuit 64 and the wireless communication unit 65, and supplies it to the control circuit 64 and the wireless communication unit 65. Note that the potential in the DC voltage to be supplied to the drive circuit 63 is not converted by the DC/DC converter 62, and therefore, the drive circuit 63 is driven by the DC voltage (e.g., 12 V) supplied from the power source circuit 11. The drive circuit 63 controls driving the light source section 56 by the DC voltage by a constant current.

<Operation when Attaching/Detaching Light Source Unit 50>

Next, the operation when the light source unit 50 is attached to and detached from the light fixture unit 20 will be described.

Figure 9:
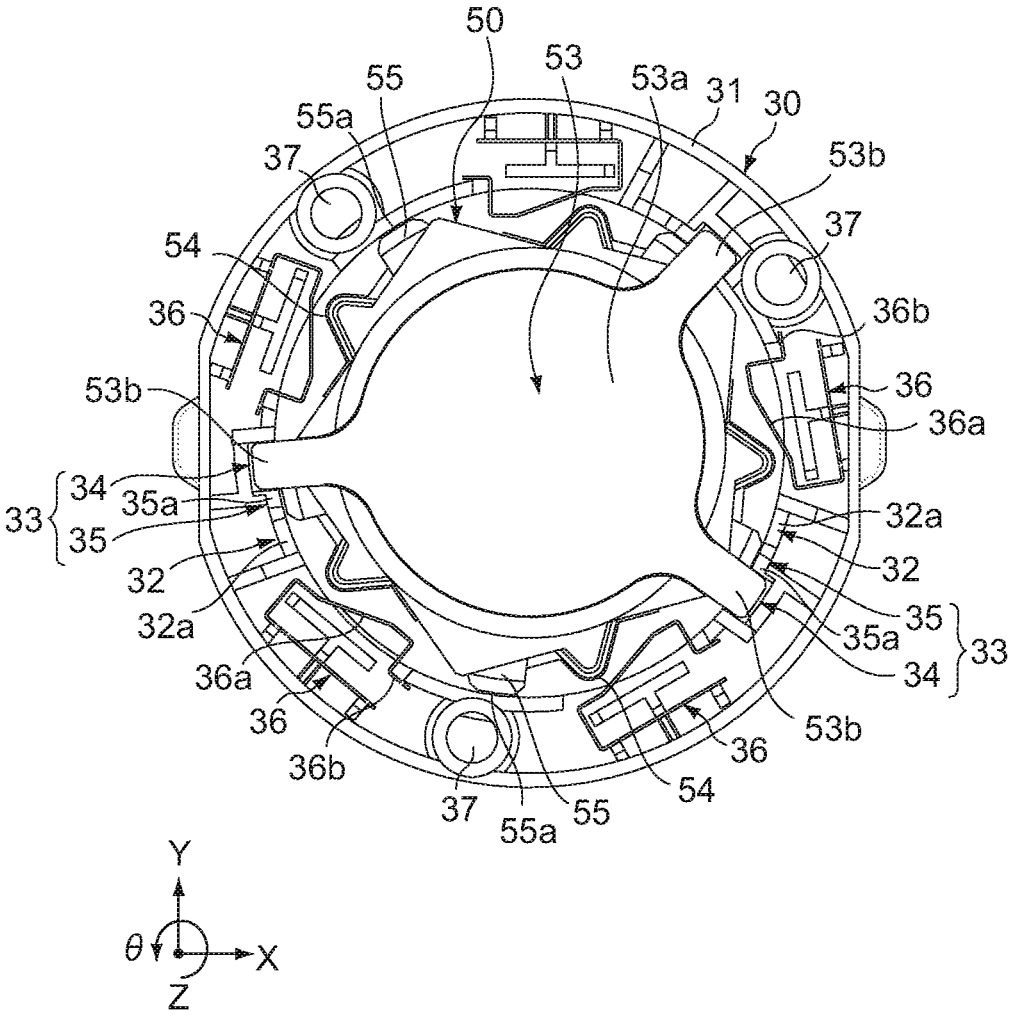
FIG. 9 is a view of the light source unit and the socket portion as viewed from above.
Figure 10:
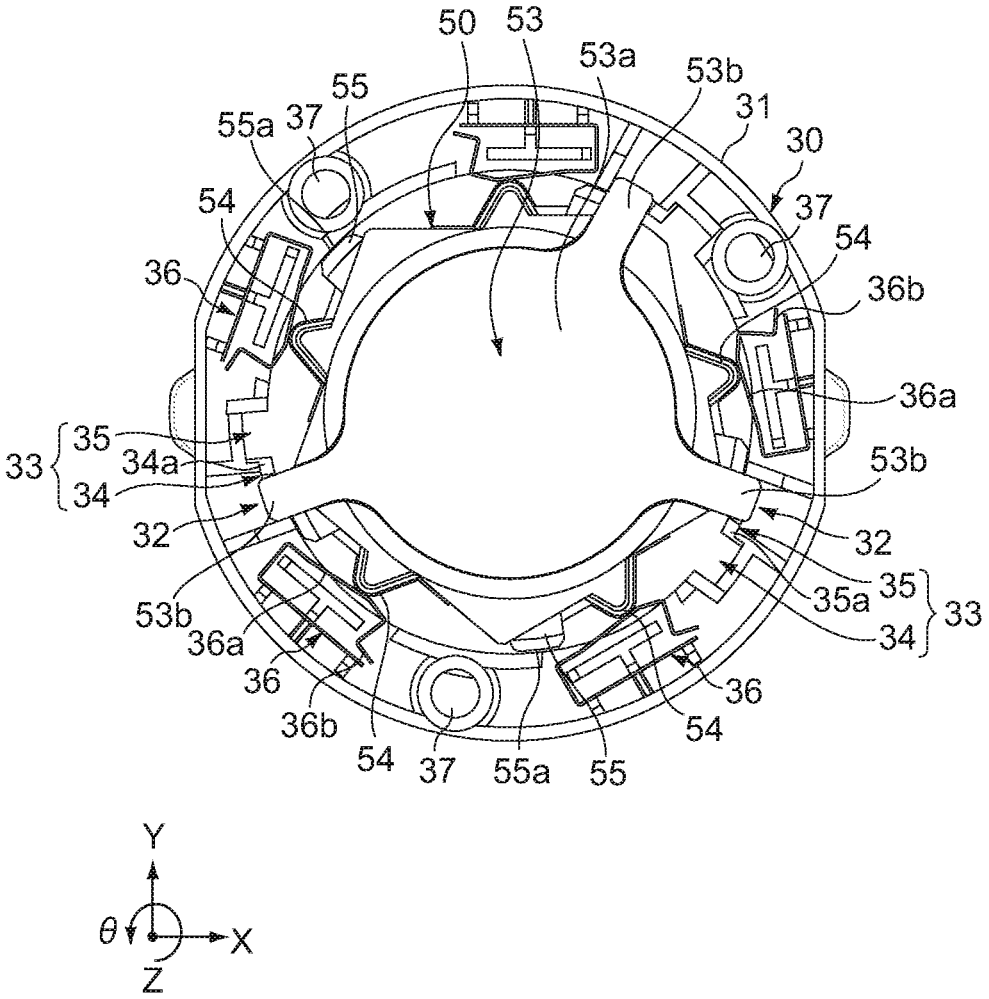
FIG. 10 is a view of the light source unit and the socket portion as viewed from above.

FIG. 9 and FIG. 10 are each a diagram describing the operation when the light source unit 50 is attached to and detached from the light fixture unit 20, and a diagram of the light source unit 50 and the socket portion 30 as viewed from above. Note that in FIG. 9, the state where the second fitting portion 53 of the light source unit 50 is moved to the upper side of the socket portion 30 of the light fixture unit 20 is shown. Further, FIG. 10 shows the state where the blade portions 53*b* in the second fitting portion 53 of the light source unit 50 fit with the first fitting portions 32 in the light fixture unit 20.

[Operation when Attaching Light Source Unit 50]

First, the operation when attaching the light source unit 50 to the light fixture unit 20 will be described. In this case, a user selects the light source unit 50 including an arbitrary additional functional section 58 first from various types of the light source unit 50 including different types of the additional functional section 58. Then, the lower side of the light source unit 50 is grasped by the user, and the grasped light source unit 50 is lifted and inserted into the outer contour portion 21 from below the outer contour portion 21.

Figure 11:
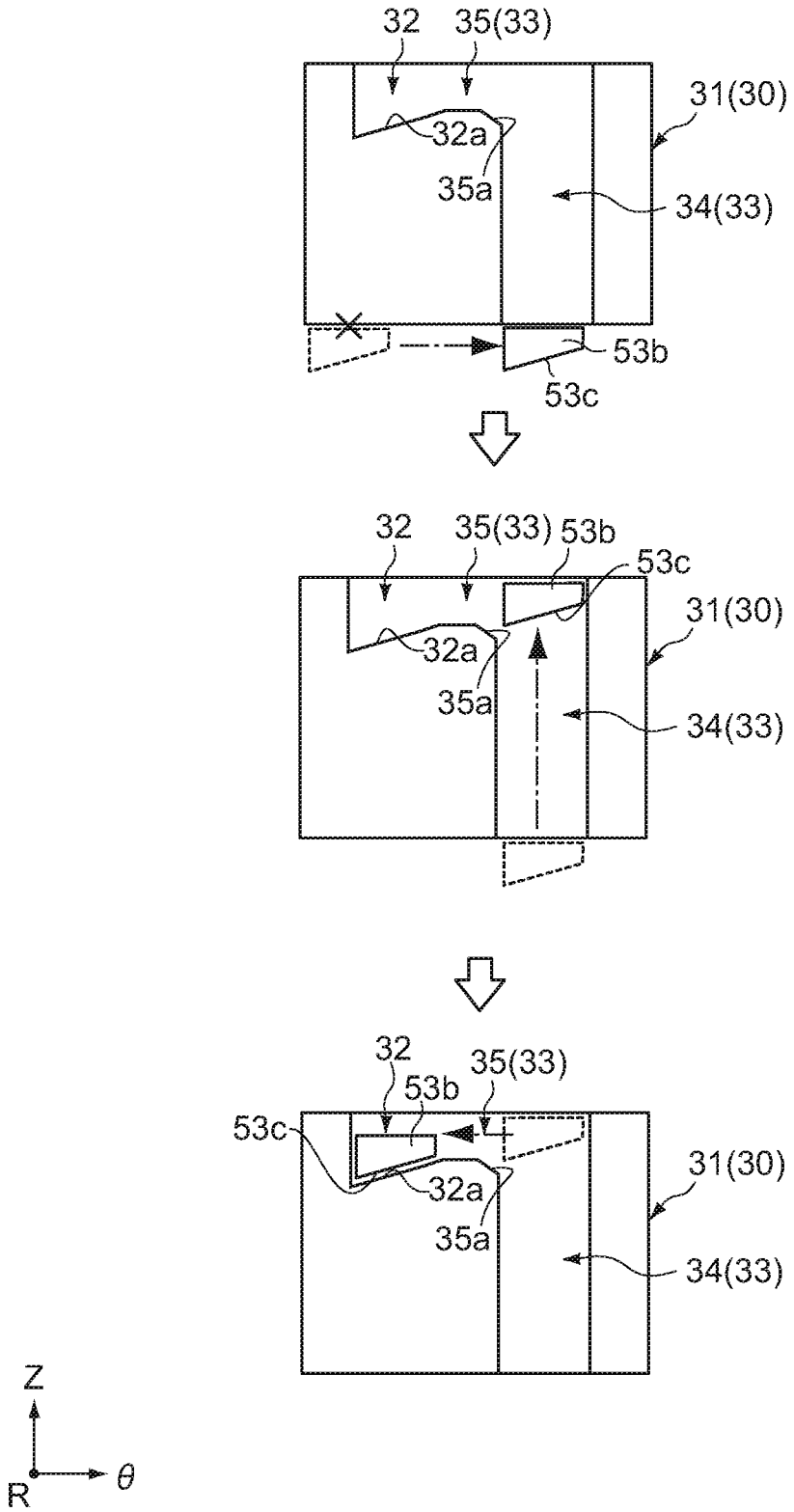
FIG. 11 is a diagram showing the state when a blade portion in a second fitting portion of the light source unit fits with a first fitting portion of the light fixture unit.

FIG. 11 is a diagram showing the state where the blade portions 53*b* in the second fitting portion 53 of the light source unit 50 fit with the first fitting portions 32 of the light fixture unit 20.

In the case where the positions of the blade portions 53*b* of the light source unit 50 do not match with the positions of the first guided 34 of the light fixture unit 20, the blade portions 53*b* is caught on the lower surface of the socket portion body 31, and thus, the light source unit 50 is not further lifted (see the top of FIG. 11). In this case, the user rotates the light source unit 50 around the Z axis to cause the positions of the blade portions 53*b* and the positions of the first guides 34 to match with each other (see FIG. 9 and the top of FIG. 11).

In the case where the light source unit 50 is further lifted while the positions of the blade portions 53*b* and the positions of the first guides 34 match with each other, the blade portions 53*b* are guided by the first guide 34*s* in the Z-axis direction, and the light source unit 50 is moved upward (see FIG. 9 and the second from the top of FIG. 11).

In the case where deviation occurs between the blade portions 53*b* and the first guides 34 in a horizontal direction while the blade portions 53*b* are guided by the first guides 34 in the Z-axis direction, the contact surface 55*a* in the contact portions 55 provided in the light source unit 50 comes into contact with the inner peripheral surface of the socket portion body 31. As a result, the blade portions 53*b* are stably guided by the first guides 34 (the light source unit 50 is stably moved upward relative to the light fixture unit 20).

After the blade portions 53*b* are moved to the uppermost position (position at which the light source unit 50 comes into contact with the lower surface of the lid portion 21*b* in the outer contour portion 21) of the socket portion 30, the user rotates the light source unit 50 counterclockwise (clockwise as viewed from the user side (lower side)) (see the bottom of FIG. 11). At this time, the blade portions 53*b* are guided by the second guides 35 in the socket portion 30 and rotate relative to the socket portion 30.

In the case where deviation occurs between the blade portions 53*b* and the second guides 35 in a horizontal direction while the blade portions 53*b* are guided by the second guides 35, the contact surface 55*a* in the contact portions 55 provided in the light source unit 50 comes into contact with the inner peripheral surface of the socket portion body 31. As a result, the blade portions 53*b* are stably guided by the second guides 35 (the light source unit 50 is stably rotated relative to the light fixture unit 20).

Here, typically, the user rotates the light source unit 50 counterclockwise while the blade portions 53*b* have been moved to the uppermost position of the socket portion 30 (hereinafter, the top position: position at which the light source unit 50 cannot move further upward). Meanwhile, since the light fixture unit 20 is basically installed at a high position, it is difficult for the user to accurately move the light source unit 50 to the top position in some cases. In this case, the light source unit 50 is rotated by the user in some cases while the blade portions 53*b* are near the top position but have not accurately reached the top position. In this case, if no measures are taken, assumption is made that the blade portions 53*b* are not easily guided by the second guides 35 and the light source unit 50 does not easily rotate.

For this reason, in this embodiment, the inclined portion 35*a*, which is inclined upward in the counterclockwise direction in the circumferential direction, is provided at a position that is on the lower side and closer to the first guide 34 in the second guide 35. In the case where rotation of the light source unit 50 is started while the blade portions 53*b* are near the top position but have not accurately reached the top position, the corner portion (left side in FIG. 11) on the lower side of the blade portions 53*b* comes into contact with the inclined portion 35*a* in the second guide 35 first. Then, in the case where the light source unit 50 is further rotated from this state, the blade portions 53*b* rotates while the corner portion on the lower side of the respective blade portions 53*b* is in contact with the inclined portion 35*a*, and the rotating blade portions 53*b* are smoothly guided into the second guides 35 while being moved upward.

That is, since the inclined portion 35*a* in the second guide 35 is inclined upward in the counterclockwise direction, the entrance from the first guide 34 to the second guide 35 can be widened, and the rotating blade portions 53*b* can be smoothly guided into the second guide 35 while being moved upward. As described above, in this embodiment, it is possible to prevent the blade portions 53*b* from being not easily guided by the second guides 35 and the light source unit 50 from not easily rotating when the light source unit 50 is rotated while the blade portions 53*b* have not accurately reached the top position.

In the case where the blade portions 53*b* are rotated by a predetermined angle (e.g., 15°) by the rotation of the light source unit 50, the blade portions 53*b* fit with the first fitting portions 32 (see FIG. 10 and the bottom of FIG. 11).

When the light source unit 50 is rotated, the tip (on the outer side in the radial direction) of the second terminal 54 is rotated while being in contact with the inclined portion 36*a* on the side of the free end in the first terminal 36. The inclined portion 36*a* on the side of the free end in the first terminal 36 comes into contact with the tip of the rotating second terminal 54 while changing the contact point, and is gradually moved toward the outside in the radial direction by the rotating second terminal 54.

In the case where the blade portions 53*b* fit with the first fitting portions 32 and the rotation of the light source unit 50 is stopped, the movement of the free end of the first terminal 36 toward the outside in the radial direction is stopped. At this time, an urging force of the free end of the first terminal 36 for urging the second terminal 54 toward the inside in the radial direction is generated, and the urging force maintains the contact between the first terminal 36 and the second terminal 54 (see FIG. 10). As a result, the electrical connection between the first terminals 36 and the second terminals 54 is ensured.

[Operation when Detaching Light Source Unit 50]

Next, the operation when detaching the light source unit 50 from the light fixture unit 20 will be described. Note that for example, the light source unit 50 is detached in the following cases: (1) where the user desires to replace the light source unit 50 that has already been attached with another light source unit 50 including the additional functional section 58 different from that of the present light source unit 50; (2) where the user desires to replace the light source unit 50 that has already been attached with another light source unit 50 including the light source section 56 (brightness, color, light distribution angle, or the like) different from that of the present light source unit 50; and (3) where the user desires to replace the light source unit 50 that has already been attached with a new light source unit 50 because a part of the present light source unit 50 is broken.

Figure 12:
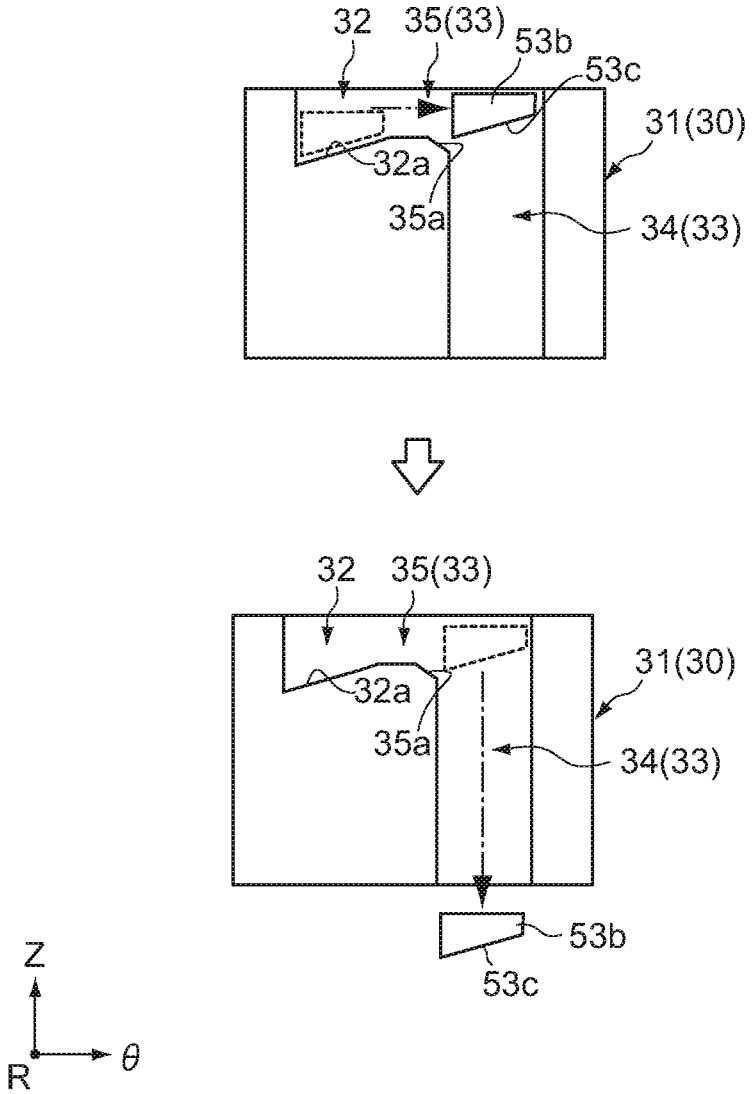
FIG. 12 is a diagram showing the state when the blade portion in the second fitting portion of the light source unit is detached from the first fitting portion of the light fixture unit.

FIG. 12 is a diagram showing the state when the blade portions 53*b* in the second fitting portions 53 of the light source unit 50 are detached from the first fitting portions 32 of the light fixture unit 20.

In the case where the light source unit 50 is detached from the light fixture unit 20, the lower side of the light source unit 50 is grasped by the user and the grasped light source unit 50 is rotated clockwise (counterclockwise as viewed from the user side (lower side). In the case where the light source unit 50 is rotated, the blade portions 53*b* of the light source unit 50 are rotated accordingly, the blade portions 53*b* are detached from the first fitting portions 32, and the blade portions 53*b* are guided into the first guides 34 via the second guides 35 (see FIG. 9 and the upper side of FIG. 12).

In the case where deviation in the horizontal direction occurs between the blade portions 53*b* and the second guides 35 when the blade portions 53*b* are rotated, the contact surface 55*a* in each of the contact portions 55 provided in the light source unit 50 comes into contact with the inner peripheral surface of the socket portion body 31. As a result, the blade portions 53*b* are stably guided by the second guides 35 (the light source unit 50 is stably rotated relative to the light fixture unit 20).

Here, the bottom portion 32*a* of each of the first fitting portions 32 is formed so as to be inclined upward in the clockwise direction in the circumferential direction. Similarly, the lower surface 53*c* of each of the blade portions 53*b* is formed so as to be inclined upward in the clockwise direction in the circumferential direction. Since the lower surface 53*c* of each of the blade portions 53*b* and the bottom portion 32*a* of each of the first fitting portions 32 have similar shapes, it is possible to appropriately cause the blade portions 53*b* to fit with the first fitting portions 32 in the case where the blade portions 53*b* fit with the first fitting portions 32.

Meanwhile, when the blade portions 53*b* are detached from the first fitting portions 32, the blade portions 53*b* are rotated while the lower surface 53*c* of each of the blade portions 53*b*, which is inclined upward in the clockwise direction, is in contact with the bottom portion 32*a* inclined upward in the clockwise direction. At this time, it is possible to easily detach the blade portions 53*b* from the first fitting portions 32, and smoothly introduce the rotating blade portions 53*b* into the second guides 35.

That is, in the embodiment, because of the shape of each of the blade portions 53*b* and the first fitting portions 32, it is possible to cause the blade portions 53*b* to appropriately fit with the first fitting portions 32 when the blade portions 53*b* fit with the first fitting portions 32, and easily detach the blade portions 53*b* from the first fitting portions 32 when the blade portions 53*b* is detached from the first fitting portions 32.

In the case where the light source unit 50 is rotated clockwise, the inclined portion 36*a* on the free end side of the first terminal 36 comes into contact with the tip of the rotating second terminal 54 while changing the contact point, and is gradually moved toward the inside in the radial direction by its own urging force.

In the case where the light source unit 50 is rotated by a predetermined angle, the tip of the second terminal 54 is separated from the first terminal 36, and the claw portion 36*b* of the first terminal 36 is hung on the socket portion body 31. As a result, the contact between the first terminal 36 and the second terminal 54 is released, and the electrical connection between the first terminals 36 and the second terminals 54 is released.

In the case where the light source unit 50 is moved downward after the blade portions 53*b* are guided to the upper portion of the first guides 34 via the second guides 35, the blade portions 53*b* is moved downward while being guided by the first guides 34 in the Z-axis direction, which detaches the blade portions 53*b* from the first guides 34.

In the case where deviation in the horizontal direction occurs between the blade portions 53*b* and the first guides 34 when the blade portions 53*b* are guided by the first guides 34 in the Z-axis direction, the contact surface 55*a* in each of the contact portions 55 provided in the light source unit 50 comes into contact with the inner peripheral surface of the socket portion body 31. As a result, the blade portions 53*b* are stably guided by the first guides 34 (the light source unit 50 is stably moved downward relative to the light fixture unit 20).

The blade portions 53*b* are detached from the first guides 34, and thus, the light source unit 50 is detached from the light fixture unit 20.

<Operation, etc.>

[Additional Functional Section 58]

As described above, in the downlight 100 according to this embodiment, the light source unit 50 includes the light source section 56 that emits light as illumination, and the additional functional section 58 having an additional function other than lighting, and the light source unit 50 is configured to be attachable/detachable to/from the light fixture unit 20. In this embodiment, since the light source unit 50 is configured to be attachable/detachable to/from the light fixture unit 20, the user is capable of easily attaching the light source unit 50 including the additional functional section 58 to the light fixture unit 20 and easily detaching the light source unit 50 including the additional functional section 58 from the light fixture unit 20.

Further, in this embodiment, for example, various types of the light source unit 50 (first light source unit 50 and second light source unit 50) such as the light source unit 50 equipped with a speaker, the light source unit 50 equipped with a projector, and the light source unit 50 equipped with a camera are prepared. As a result, the user is capable of selecting the light source unit 50 including an arbitrary additional functional section 58 from the various types of the light source unit 50, and attaching the selected light source unit 50 to the light fixture unit 20.

Further, in the case where the user desires to replace the light source unit 50 that has already been attached with a different light source unit 50 including a different additional functional section 58, the user is capable of detaching the present light source unit 50 from the light fixture unit 20, and then, attaching the different light source unit 50 including the different additional functional section 58 to the light fixture unit 20. That is, in this embodiment, the user is capable of easily replacing the light source unit 50 that has already been attached with a light source unit 50 including a desired additional functional section 58 at any time.

Further, in this embodiment, the additional functional section 58 is disposed at the center position of the annular light source section 56. As a result, in the light source section 56, it is possible to achieve light distribution characteristics similar to those in the light source section of a normal downlight that does not include the additional functional section 58. Further, it is also possible to improve the design in the downlight 100. Further, for example, in the case where a speaker is disposed at the center position of the annular light source section 56 serving as the additional functional section 58, the spread of sound output from the speaker can be made symmetrical relative to the position directly below the downlight 100.

Note that the position of the additional functional section 58 does not necessarily need to be exactly the center position and may be slightly deviated from the center position of the annular light source section 56 as long as the light source section 56 is capable of achieving favorable light distribution characteristics (also in this case, it is included in the center position the light source section 56).

[Wireless Communication Unit 65]

Further, in this embodiment, the wireless communication unit 65 that performs wireless communication with the wireless device 3 (another device) is provided in the light source unit 50. Then, the control circuit 64 controls the additional functional section 58 on the basis of information that is transmitted from the wireless device 3 and is received by the wireless communication unit 65.

As a result, for example, in the case where the additional functional section 58 is a speaker or a projector, the user is capable of causing the additional functional section 58 to output desired sound or a desired image by transmitting information regarding the sound or image from the wireless device 3 to the downlight 100. Further, in the case where the additional functional section 58 is various types of sensors such as a temperature sensor and a humidity sensor, a camera, a microphone, or the like, the user is capable of causing the downlight 100 to transmit, to the wireless device 3, the information acquired by the additional functional section 58, which is the various sensors, camera, or microphone, or the like. As a result, the user is capable of checking, in the wireless device 3, the information acquired by the additional functional section 58, which is the various sensors, camera, microphone, or the like.

Further, in this embodiment, the control circuit 64 controls, on the basis of the information that is transmitted from the wireless device 3 and received by the wireless communication unit 65, the drive circuit 63 to control the light source section 56. As a result, the user is capable of arbitrarily selecting ON/OFF of the light source section 56, brightness of the light source section 56, color of the light source section 56, and the like by causing the wireless device 3 to transmit the information (e.g., information for turning on/off the light source section 56, light adjustment, or toning) for controlling the light source section 56.

[Comparison with Comparative Examples, Power Supply, Etc.]

Next, the operation and the like in this embodiment will be described with reference to Comparative Examples.

Figure 13:
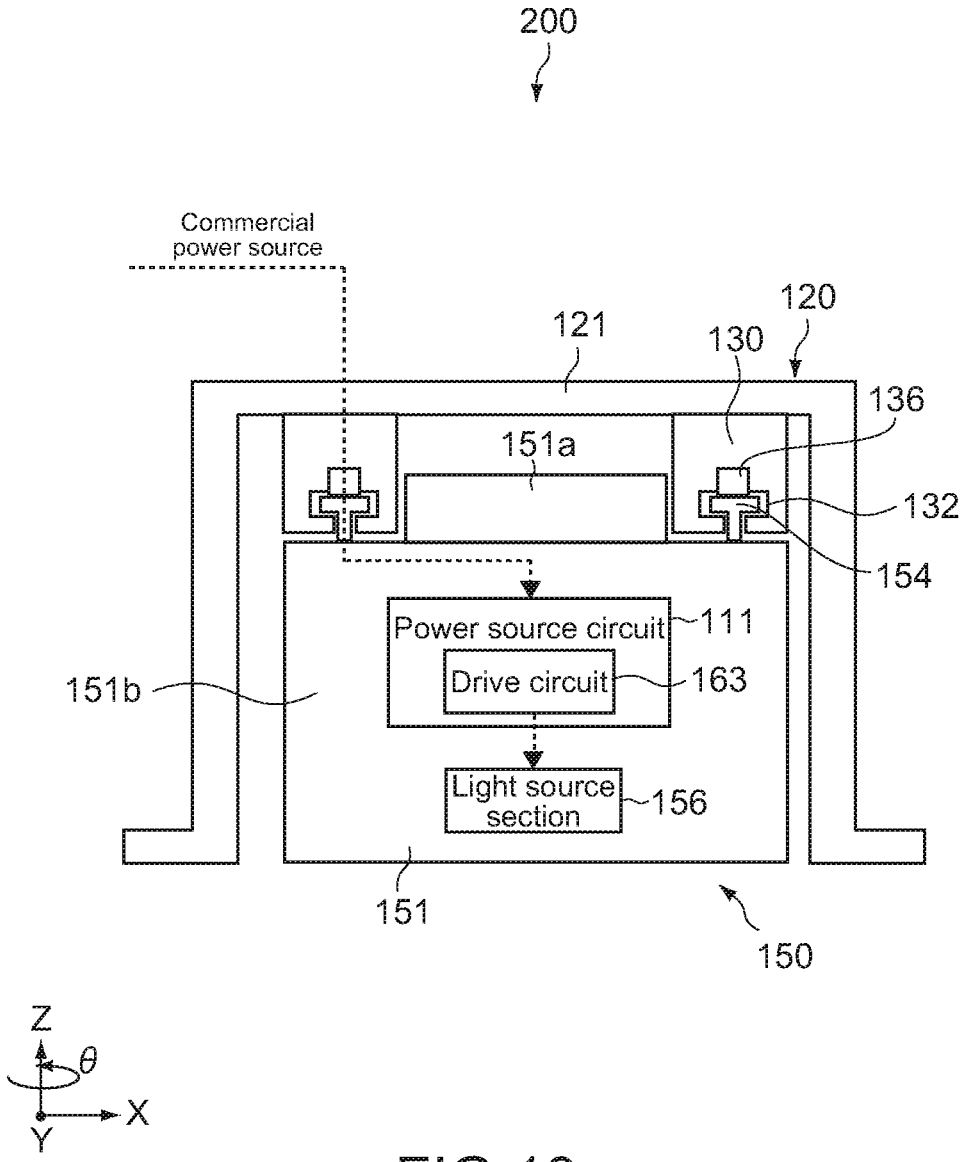
FIG. 13 is a schematic diagram showing a downlight according to a first Comparative Example.

FIG. 13 is a schematic diagram showing a downlight 200 according to a first Comparative Example. As shown in FIG. 13, the downlight 200 according to the first Comparative Example includes a light fixture unit 120 and a light source unit 150. Note that the downlight 100 according to the first Comparative Example does not include the power source unit 10 unlike this embodiment, and the light source unit 150 includes a power source circuit 111 therein.

The light fixture unit 120 includes an outer contour portion 121 and a socket portion 130 provided in the outer contour portion 121. The socket portion 130 includes a fitting portion 132 and a first terminal 136.

The light source unit 150 includes a casing 151, second terminals 154, the power source circuit 111, and a light source section 156. Note that the light source unit 150 does not include the additional functional section 58, the control circuit 64, the wireless communication unit 65, and the like unlike this embodiment. The casing 151 includes a small diameter portion 151*a* on the upper side and a large diameter portion 151*b* on the lower side. The second terminals 154 are each provided so as to project upward from the upper surface of the large diameter portion 51*b* of the casing 151. Of the second terminals 154, one second terminal 154 is a positive terminal and the other second terminal 154 is a ground terminal. Further, the second terminals 154 each have two functions, i.e., a function as a terminal for electrical connection and a function as a fitting portion for mechanical connection.

The power source circuit 111 is integrally formed with a drive circuit 163. The power source circuit 111 converts the AC voltage from the commercial power source into the DC voltage, and supplies it to the drive circuit 163. The drive circuit 163 drives the light source section 156 (LED) by the DC voltage by a constant current.

In the first Comparative Example, when the light source unit 150 is attached to the light fixture unit 120, the light source unit 150 is inserted from below the light fixture unit 120 and the light source unit 150 is rotated. When the light source unit 150 is rotated, the second terminal 154 fits with the fitting portion 132, and the second terminal 154 is electrically connected to the first terminal 136.

Meanwhile, when the light source unit 150 is detached from the light fixture unit 120, the light source unit 150 is rotated in the direction opposite to the direction in the above relative to the light fixture unit 120. When the light source unit 150 is rotated, fitting between the second terminal 154 and the fitting portion 132 is released, and the electrical connection between the first terminal 136 and the second terminal 154 is released. After that, when the light source unit 150 is moved downward, the light source unit 150 is detached from the light fixture unit 120.

Figure 14:
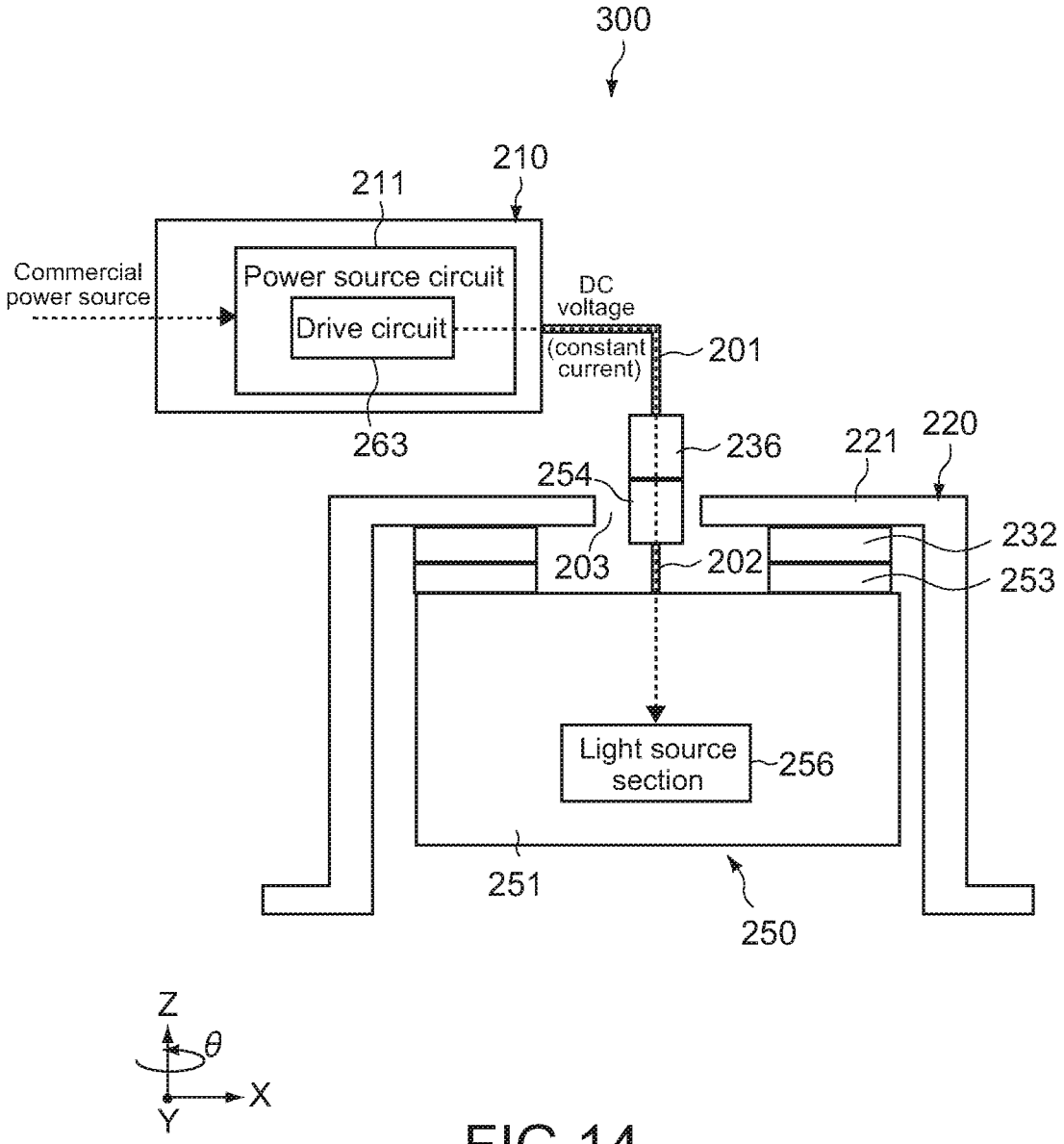
FIG. 14 is a schematic diagram showing a downlight according to a second Comparative Example.

FIG. 14 is a schematic diagram showing a downlight 300 according to a second Comparative Example. As shown in FIG. 14, a downlight 300 the second Comparative Example includes a power source unit 210, a light fixture unit 220, and a light source unit 250.

The power source unit 210 includes a power source circuit 211. The power source circuit 211 is integrally formed with a drive circuit 263. The power source circuit 211 converts the AC voltage from the commercial power source into the DC voltage, and supplies it to the drive circuit 263. The drive circuit 263 drives a light source section 256 (LED) by the DC voltage at a constant current. A wiring 201 including a first connector 236 at the tip portion is attached to the power source unit 210.

The light fixture unit 220 includes an outer contour portion 221 and a first fitting body 232 provided in the outer contour portion 221. An opening 203 for passing the wiring 201 and a wiring 202 is provided in the vicinity of the center of the upper portion of the outer contour portion 221.

The light source unit 250 includes a casing 251, a second fitting body 253 provided in the casing 251, and the light source section 256 (LED) provided inside the casing 251. Further, the wiring 202 including a second connector 254 is attached to the light source unit 250. Note that the light source unit 250 does not include the additional functional section 58, the control circuit 64, the wireless communication unit 65, and the like unlike this embodiment.

The second fitting body 253 is configured to be attachable/detachable to/from the first fitting body 232. Further, the second connector 254 is configured to be attachable/detachable to/from the first connector 236.

In the second Comparative Example, when the light source unit 250 is attached to the light fixture unit 220, the wiring 201 provided in the power source unit 210 and the first connector 236 are pulled downward first. As a result, the wiring 201 and the first connector 236 are drawn from the opening 203 provided in the light fixture unit 220. After that, the first connector 236 on the side of the power source unit 210 and the second connector 254 on the side of the light source unit 250 are connected to each other, and electrical connection of the light source unit 250 to the power source unit 210 is performed. Then, the light source unit 250 is pushed into the light fixture unit 220 from below and the first fitting body 232 and the second fitting body 253 fit with each other, thereby performing mechanical connection of the light source unit 250 to the light fixture unit 220.

Meanwhile, in the case where the light source unit 250 is moved downward when the light source unit 250 is detached from the light fixture unit 220, the mechanical connection between the first fitting body 232 and the second fitting body 253 is released. After that, the second connector 254 on the side of the light source unit 250 is detached from the first connector 236 on the side of the power source unit 210, thereby releasing the electrical connection.

Referring to FIG. 13, in the first Comparative Example, the mechanical connection/release and the electrical connection/release are simultaneously performed by the movement and rotation of the light source unit 150 in the vertical direction. For this reason, the light source unit 150 can be easily attached to and detached from the light fixture unit 120. However, in the first Comparative Example, the function for mechanical connection/release is imposed on the second terminal 154 for performing electrical connection/release. For this reason, mechanical stress is applied to the second terminal 154, and therefore, there is a problem that the reliability of electrical connection is low.

Further, in the first Comparative Example, the AC voltage from the commercial power source is supplied to the light source unit 150 as it is. For this reason, there is a problem that the user may be electrocuted when the light source unit 150 is attached to and removed from the light fixture unit 120. Further, there is also a problem that the possibility of electric leakage increases when rain leaks in the back of the ceiling.

Further, in the first Comparative Example, since the power source circuit 111 is incorporated in the light source unit 150, the light source unit 150 becomes heavy, which causes a problem that the burden on the user increases when the light source unit 150 is attached or detached.

Referring to FIG. 14, in the second Comparative Example, the AC voltage from the commercial power source is converted into the DC voltage by the power source unit 210 unlike the first Comparative Example, and the DC voltage is supplied to the light source unit 250 via the first connector 236 and the second connector 254. For this reason, the risk of electric shock or electric leakage is reduced.

Meanwhile, in the second Comparative Example, the mechanism for mechanical connection (the first fitting body 232 and the second fitting body 253) between the light fixture unit 220 and the light source unit 250 and the mechanism (the first connector 236 and the second connector 254) for electrical connection are completely separated from each other. For this reason, when the light source unit 250 is attached to and detached from the light fixture unit 220, the user needs to separately perform connection/release of the first connector 236 and the second connector 254 and connection/release of the first fitting body 232 and the second fitting body 253. There is a problem that the user needs to perform these operations with his/her hand raised toward the ceiling and the burden on the user is large.

Further, in both the first Comparative Example and the second Comparative Example, the additional functional section 58 is not provided and there is a problem that it is difficult to add the additional functional section 58 to the light source unit 150 or 250.

In the first Comparative Example, since the power source circuit 111 is incorporated in the light source unit 150, it is difficult to secure a space for adding the additional functional section 58. Meanwhile, in the second Comparative Example, since the power source circuit 211 is not disposed inside the light source unit 250, it is possible to secure a space for adding the additional functional section 58.

However, in the second Comparative Example, the drive circuit 263 for driving the light source section 256 (LED) is integrally formed with the power source circuit 211. Here, the LED is driven by being applied with the DC voltage. In the case where the LED is driven with the DC voltage by a constant voltage in which the voltage is constant, variations in brightness occur in each LED. For this reason, normally, the LED is driven with the DC voltage by a constant current in which the current is constant as in the second Comparative Example.

In the second Comparative Example, the power supplied from the drive circuit 263 to the light source unit 250 is a DC voltage, i.e., a DC voltage by a constant current for the above-mentioned reason. There is a problem that the additional functional section 58, the control circuit 64, and the wireless communication unit 65 cannot be driven with the DC voltage by a constant current. This is because the additional functional section 58, the control circuit 64, and the wireless communication unit 65 are driven by the DC voltage by a constant voltage.

Meanwhile, in this embodiment, the power source circuit 11 and the drive circuit 63 are separated from each other, the power source circuit 11 is disposed in the power source unit 10, and the drive circuit 63 is disposed in the light source unit 50 (see FIG. 8) unlike the first Comparative Example and the second Comparative Example. Then, in this embodiment, the power source circuit 11 converts the AC voltage from the commercial power source into a DC voltage by a constant voltage, and the DC voltage by the constant voltage is supplied to the light source unit 50 via the light fixture unit 20. Further, the DC voltage by the constant voltage is branched in the light source unit 50, and supplied to the drive circuit 63, the control circuit 64, the wireless communication unit 65, and the like.

As a result, in this embodiment, it is possible to appropriately drive the light source section 56 by the constant current control by the drive circuit 63 while appropriately driving the drive circuit 63, the control circuit 64, the additional functional section 58, and the wireless communication unit 65 that are driven by the DC voltage by a constant voltage.

Further, in this embodiment, since the DC voltage by a constant voltage is supplied to the light source unit 50, it is possible to reduce the risk of electric shock or electric leakage as compared with the case where the AC voltage from the commercial power source is directly supplied to the light source unit 50 (first Comparative Example). Note that in this embodiment, the DC voltage to be supplied to the light source unit 50 is typically set to 40 V or less from the viewpoint of preventing electric shock and the like from occurring.

Further, in this embodiment, since the power source circuit 11 is incorporated in not the light source unit 50 but the power source unit 10, the problem that the light source unit 50 becomes heavy and the burden on the user when the light source unit 50 is attached or detached increases can be solved.

[Potential of Outer Contour Portion 21]

Further, as described above, in this embodiment, the ground side of the DC voltage to be supplied from the power source unit 10 to the light source unit 50 is electrically connected to the outer contour portion 21 of the light fixture unit 20, and the outer contour portion 21 of the light fixture unit 20 is set to the same potential as the ground potential of the DC voltage. Here, for example, in the case where the outer contour portion 21 is formed of metal, if the outer contour portion 21 has a potential different from the ground potential, there is a problem that a parasitic capacitance is generated between the outer contour portion 21 and the additional functional section 58 or the like, which makes the ground potential unstable.

Meanwhile, in this embodiment, since the outer contour portion 21 is set to the same potential as the ground potential, it is possible to improve the stability of the ground potential. As a result, it is possible to improve the stability of the operation of each of the additional functional section 58, the control circuit 64, the wireless communication unit 65, and the drive circuit 63. Further, since the outer contour portion 21 is set to the same potential as the ground potential, it is possible to realize favorable EMC (Electro-Magnetic Compatibility) countermeasures. Note that since the outer contour portion 21 covers the light source unit 50 including the light source section 56, the additional functional section 58, and the like, by setting the outer contour portion 21 to the ground potential, a shielding effect can also be expected, which is more effective for EMC countermeasures.

[Fitting Structure]

Further, in this embodiment, as the mechanism for attaching/detaching the light source unit 50 to/from the light fixture unit 20, the first fitting portions 32 and the guides 33 are provided on the side of the light fixture unit 20, and the second fitting portions 53 are provided on the side of the light source unit 50. As a result, the user is capable of attaching/detaching the light source unit 50 to/from the light fixture unit 20 by a simple operation of moving the light source unit 50 in the vertical direction and rotating the light source unit 50 around the Z axis.

Further, in this embodiment, the inclined portion 35*a* inclined upward in the counterclockwise direction in the circumferential direction is provided at a position closer to the first guide 34 on the lower side of the second guide 35. As a result, it is possible to smoothly guide the blade portion 53*b* from the first guide 34 into the second guide 35. Therefore, it is possible to prevent the blade portions 53*b* from being not easily guided by the second guides 35 and the light source unit 50 from not easily rotating when the light source unit 50 is rotated while the blade portions 53*b* have not accurately reached the top position.

Further, in this embodiment, the bottom portion 32*a* of the first fitting portion 32 of the light fixture unit 20 is formed so as to be inclined upward in the counterclockwise direction in the circumferential direction. Similarly, the lower surface 53*c* of the blade portion 53*b* of the light source unit 50 is formed so as to be inclined upward in the counterclockwise direction in the circumferential direction. As a result, it is possible to cause the blade portions 53*b* to appropriately fit with the first fitting portions 32 when the blade portions 53*b* fit with the first fitting portions 32, and easily detach the blade portions 53*b* from the first fitting portions 32 when the blade portions 53*b* are detached from the first fitting portions 32.

Further, in this embodiment, the second terminals 54 of the light source unit 50 are electrically connected to the first terminals 36 of the light fixture unit 20 in accordance with fitting of the light source unit 50 (second fitting portions 53) with the light fixture unit 20 (first fitting portions 32). That is, in this embodiment, since the mechanical connection/release and electrical connection/release between the light fixture unit 20 and the light source unit 50 are performed in conjunction with each other, it is possible to reduce the burden on the user as compared with the case where they are not in conjunction with each other (second Comparative Example: see FIG. 14).

Further, in this embodiment, the mechanism (the first terminals 36 and the second terminals 54) for electrical connection/release and the mechanism (the first fitting portions 32 and the second fitting portions 53) for mechanical connection/release are separated from each other. For this reason, it is possible to improve the reliability of electrical connection as compared with the case where the function of the electrical connection/release and the function of the mechanical connection/release are integrated (both functions are imposed on the second terminal 154) as in the first Comparative Example.

Further, in this embodiment, the first terminals 36 of the light fixture unit 20 are each formed in a leaf spring shape, and deformation of the first terminal 36 having a leaf spring shape performs electrical connection with the second terminal 54. As a result, it is possible to further improve the reliability of the electrical connection between the first terminals 36 and the second terminals 54.

Further, in this embodiment, the second terminals 54 of the light source unit 50 are provided on the side peripheral surface of the casing 51. As a result, it is possible to secure a large space of the light source unit 50 inside the casing 51, and easily dispose the additional functional section 58 and the like inside the casing 51. Further, since the second terminals 54 are provided on the side peripheral surface of the casing 51, it is possible to easily reduce the height (in the Z-axis direction) of the light source unit 50. Note that in the case where the second terminals 154 are provided on the upper surface (upper surface of the large diameter portion 151*b*) of the casing 151 as in the first Comparative Example, there is a problem that it is difficult to reduce the height of the light source unit 150.

Second Embodiment

<Entire Configuration of Downlight 400 and Configuration of Respective Sections>

Next, a downlight 400 according to a second embodiment of the present technology will be described. In the second embodiment and subsequent embodiments, description of members having the same configuration and function as those of the above-mentioned first embodiment will be omitted or simplified.

The second embodiment is different from the above-mentioned first embodiment in that the light source unit 50 and the light fixture unit 20 are thermally connected to each other. This point will be mainly described in the second embodiment.

Figure 15:
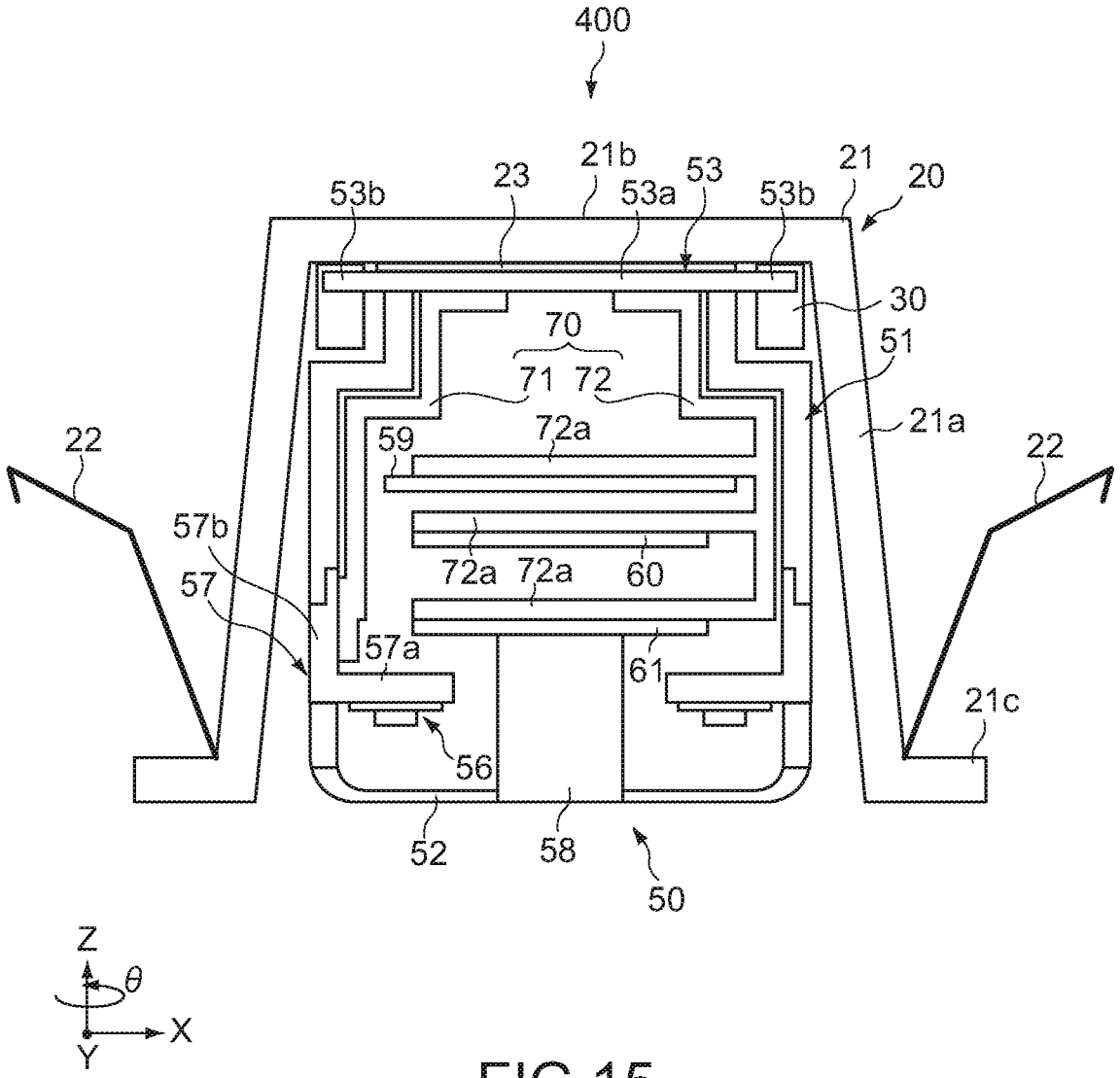
FIG. 15 is a schematic side cross-sectional view showing a downlight according to a second embodiment.
Figure 16:
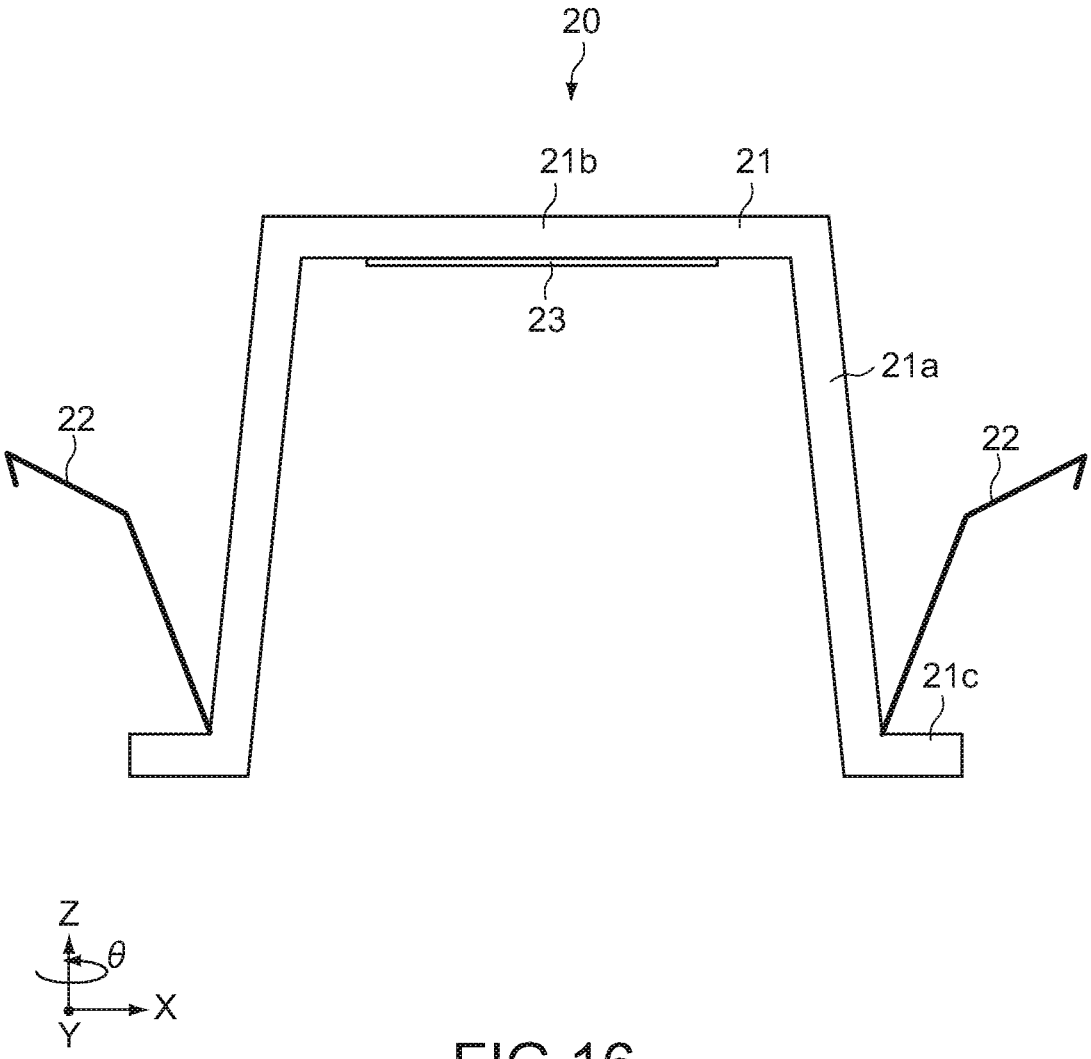
FIG. 16 is a schematic side cross-sectional view showing a light fixture unit according to the second embodiment.

FIG. 15 is a schematic side cross-sectional view showing the downlight 400 according to the second embodiment. FIG. 16 is a schematic side cross-sectional view showing the light fixture unit 20 according to the second embodiment.

As shown in the figures, the outer contour portion 21 of the light fixture unit 20 includes a projection portion 23 that projects downward (on the side of the first fitting portions 32) on the lower surface of the lid portion 21*b*. When the light source unit 50 fits with the light fixture unit 20, the projection portion 23 is thermally connected to the second fitting portion 53 (fitting portion body 53*a*) in accordance with the fitting. The projection portion 23 is formed in, for example, a circular shape as viewed from the Z-axis direction, and the thickness of the projection portion 23 is, for example, approximately 0.01 mm to 1 mm.

A heat transfer portion 70 that transfers, to the second fitting portion 53, heat from various heat sources such as the light source section 56 is provided inside the casing 51 in the light source unit 50. This heat transfer portion 70 includes a first heat transfer portion 71 that transfers, to the second fitting portion 53, heat from the light source section 56 (first heat source), and a second heat transfer portion 72 that transfers, to the second fitting portion 53, heat from the light source control substrate 59, the functional section control substrate 60, the wireless communication substrate 61, and the additional functional section 58 (second heat sources).

The first heat transfer portion 71 is provided along the inner peripheral surface of the casing 51. Note that the first heat transfer portion 71 is not provided over the entire circumference (360°) in the circumferential direction, but is provided over a predetermined angle (e.g., 160°) in the circumferential direction.

The upper portion of the first heat transfer portion 71 is fixed to the lower surface of the second fitting portion 53. As a result, the first heat transfer portion 71 is thermally connected to the second fitting portion 53. The lower portion of the first heat transfer portion 71 is fixed to the inner peripheral surface in the wall portion 57*b* of the heat sink 57.

As a result, the first heat transfer portion 71 is thermally connected to the light source section 56 via the heat sink 57.

The second heat transfer portion 72 is provided along the inner peripheral surface of the casing 51. However, the second heat transfer portion 72 is not provided over the entire circumference (360°) in the circumferential direction, but is provided over a predetermined angle (e.g., 160°) in the circumferential direction. Note that the first heat transfer portion 71 and the second heat transfer portion 72 are disposed so as not to overlap in the circumferential direction.

The upper portion of the second heat transfer portion 72 is fixed to the lower surface of the second fitting portion 53. As a result, the second heat transfer portion 72 is thermally connected to the second fitting portion 53. Meanwhile, the lower portion of the second heat transfer portion 72 is disposed so as not to be in contact with the heat sink 57 unlike the first heat transfer portion 71. Therefore, the second heat transfer portion 72 is not thermally connected to the light source section 56. Instead, to the second heat transfer portion 72, a heat transfer plate 72*a* that transfers, to the second heat transfer portion 72, heat from the light source control substrate 59, the functional section control substrate 60, the wireless communication substrate 61, and the additional functional section 58 is attached.

The second fitting portion 53 of the light source unit 50 is thermally connected to the outer contour portion 21 (projection portion 23) of the light fixture unit 20 in accordance with fitting of the light source unit 50 with the light fixture unit 20. In the second embodiment, the second fitting portion 53 is typically formed of a metal material such as copper and aluminum having high thermal conductivity, from the viewpoint of heat transfer. Note that the second fitting portion 53 may be formed of another metal material such as iron, and may be formed of a resin material or the like other than the metal material as long as strength and thermal conductivity can be secured.

Figure 17:
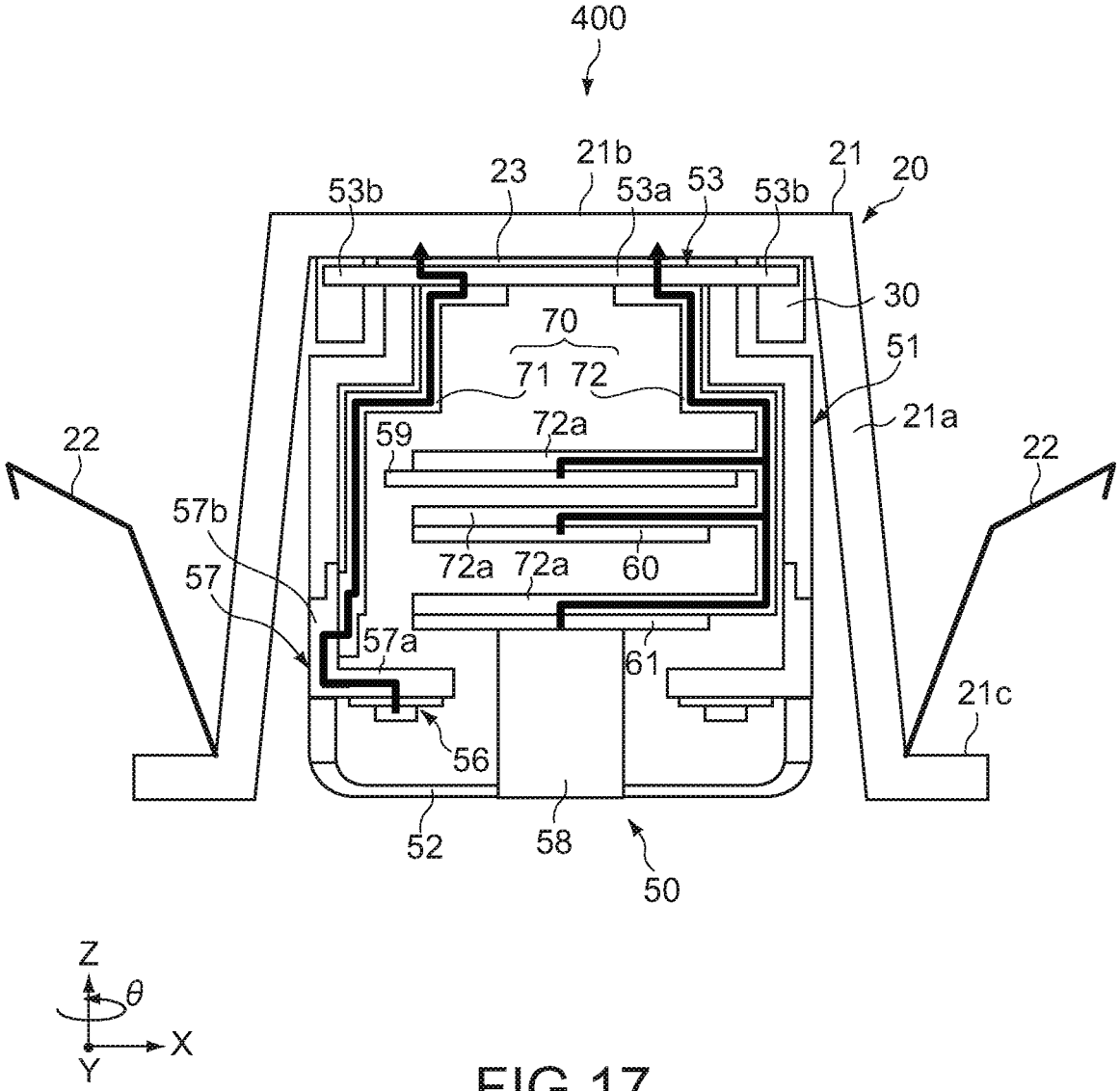
FIG. 17 is a schematic diagram showing the state of heat transfer.

FIG. 17 is a schematic side cross-sectional view showing the state of heat transfer. As shown in FIG. 17, the heat generated in the light source section 56 of the light source unit 50 is transferred to the first fitting portion 32 via the heat sink 57 and the first heat transfer portion 71. The heat that has been transferred to the first fitting portion 32 is transferred from the projection portion 23 of the light fixture unit 20 to the outer contour portion 21 and radiated from the outer contour portion 21.

Meanwhile, the heat generated in the light source control substrate 59, the functional section control substrate 60, the wireless communication substrate 61, and the additional functional section 58 of the light source unit 50 is transferred to the first fitting portion 32 via the heat transfer plate 72*a* and the second heat transfer portion 72. The heat that has been transferred to the first fitting portions 32 is transferred from the projection portion 23 of the light fixture unit 20 to the outer contour portion 21, and radiated from the outer contour portion 21.

<Operation, Etc.>

In the second embodiment, the second fitting portion 53 of the light source unit 50 is thermally connected to the outer contour portion 21 of the light fixture unit 20 in accordance with fitting of the light fixture unit 20 with the first fitting portions 32. That is, in this embodiment, since the mechanical connection/release and the thermal connection/release of the light fixture unit 20 and the light source unit 50 are performed in conjunction with each other, the user is capable of automatically performing thermal connection/release (and also electrical connection/release as described above) by performing mechanical connection/release.

Further, in the second embodiment, since the projection portion 23 is provided in the outer contour portion 21 of the light fixture unit 20, it is possible to improve the contact property between the second fitting portion 53 of the light source unit 50 and the outer contour portion 21 of the light fixture unit 20. As a result, it is possible to improve the thermal connectivity between the light source unit 50 and the light fixture unit 20. The projection portion 23 may be provided on not the side of the outer contour portion 21 but the side of the second fitting portion 53 (in this case, the projection portion 23 projects toward the outer contour portion 21). Alternatively, the projection portion 23 may be provided in both the outer contour portion 21 and the second fitting portion.

Further, in the second embodiment, the heat transfer portion 70, which guides, to the second fitting portion 53, the heat generated in heat sources such as the light source section 56, the light source control substrate 59, the functional section control substrate 60, the wireless communication substrate 61, and the additional functional section 58, is provided in the light source unit 50. Therefore, it is possible to appropriately guide, to the second fitting portion 53, the heat generated in the heat sources.

Further, in the second embodiment, the heat transfer portion 70 includes the two separated paths, i.e., the first heat transfer portion 71 and the second heat transfer portion 72. Here, in the case where the heat transfer portion 70 includes one path, high heat generated by the light source section 56 is transferred to the light source control substrate 59, the functional section control substrate 60, and the like, which are vulnerable to heat, through the heat transfer portion 70, and the light source control substrate 59, the functional section control substrate 60, and the like are adversely affected by the heat in some cases.

For this reason, in the second embodiment, the heat transfer portion 70 includes two separated paths, i.e., the first heat transfer portion 71 and the second heat transfer portion 72. Specifically, the first heat transfer portion 71 is configured to guide, to the second fitting portion 53, the heat from the light source section 56 having a high temperature of generated heat. Meanwhile, the second heat transfer portion 72 is configured to guide, to the second fitting portion 53, the heat generated from the light source control substrate 59, the functional section control substrate 60, and the like, which have a lower temperature of generated heat than the light source section 56 and are weak against heat. As a result, it is possible to prevent the members such as the light source control substrate 59 and the functional section control substrate 60 that are weak against heat from being adversely affected due to the high heat generated in the light source section 56.

Modified Example of Second Embodiment

Figure 18:
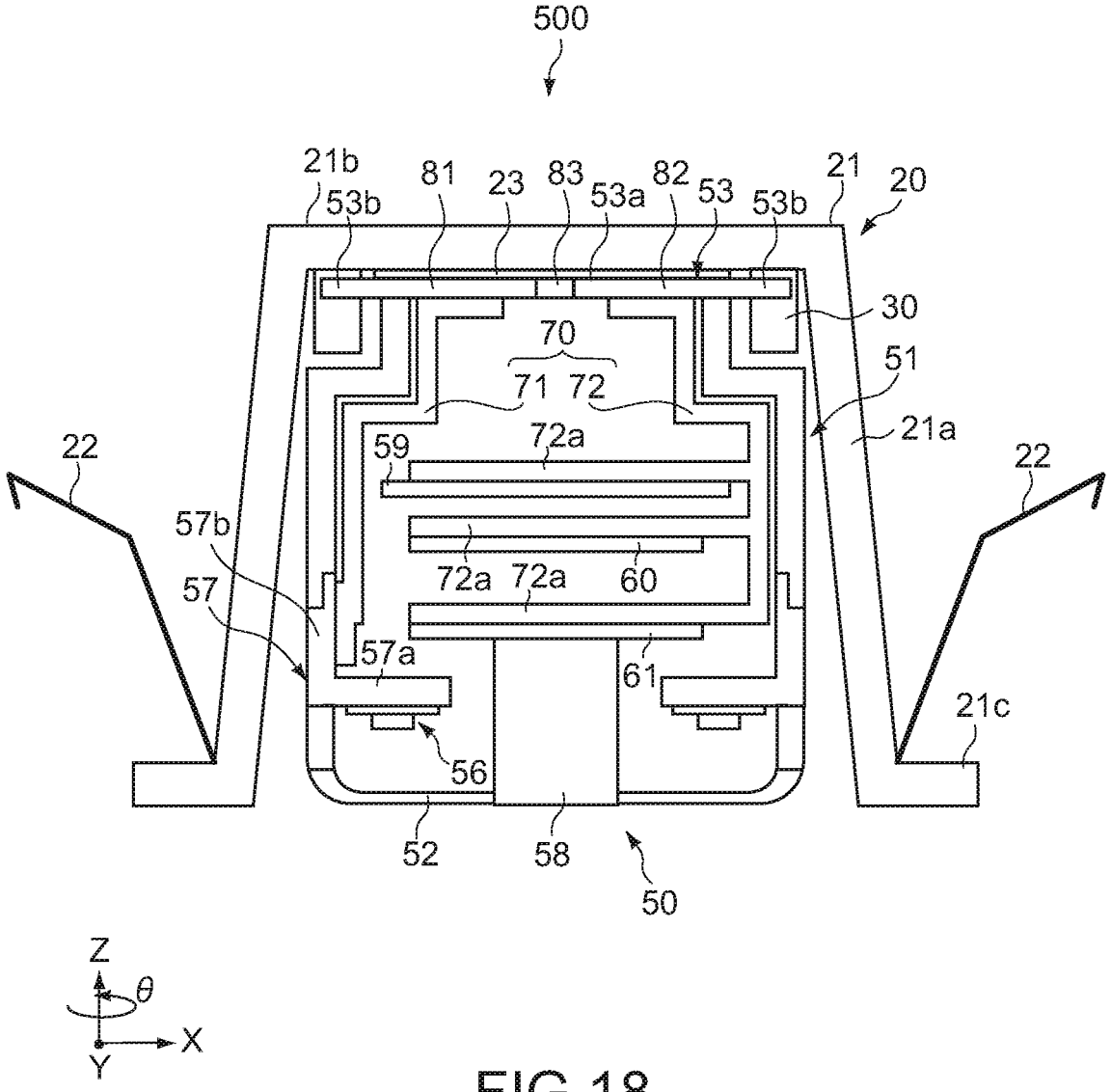
FIG. 18 is a schematic side cross-sectional view showing a downlight according to a modified example of the second embodiment.

Next, a modified example of the second embodiment will be described. FIG. 18 is a schematic side cross-sectional view showing a downlight 500 according to a modified example of the second embodiment.

The modified example of the second embodiment is different from the above-mentioned second embodiment in that the second fitting portion 53 in the light source unit 50 includes two separated members, i.e., a first fitting member 81 and a second fitting member 82.

As shown in FIG. 18, the second fitting portion 53 is separated into the two members, i.e., the first fitting member 81 and the second fitting member 82, in the vicinity of the center. A heat insulation portion 83 formed of, for example, a resin material or the like having low thermal conductivity is interposed between the first fitting member 81 and the second fitting member 82.

The upper portion of the first heat transfer portion 71 is connected to the lower surface of the first fitting member 81. Therefore, the heat from the first heat transfer portion 71 (that is, heat of the light source section 56) is transferred to the first fitting member 81. Meanwhile, the upper portion of the second heat transfer portion 72 is connected to the lower surface of the second fitting member 82, and the heat from the second heat transfer portion 72 (that is, heat of the light source control substrate 59, the functional section control substrate 60, and the like) is transferred to the second fitting member 82.

In the modified example of the second embodiment, since the second fitting portion 53 is separated into the two members, i.e., the first fitting member 81 and the second fitting member 82, it is possible to more appropriately separate the heat transfer path in the light source unit 50. Therefore, it is possible to more appropriately prevent the members such as the light source control substrate 59 and the functional section control substrate 60 that are weak against heat from being adversely affected due to the high heat generated in the light source section 56.

Although the first fitting member 81 and the second fitting member 82 have the same area (in the XY direction) in FIG. 18, the area may differ depending on the magnitude of the heat to be transferred. For example, the area of the first fitting member 81 to which relatively high heat is transferred may be larger than the area of the second fitting member 82 to which relatively low heat is transferred.

Various Modified Examples

As an example of the built-in illumination apparatus, the downlight 100 to be built in a ceiling and used has been described above. Meanwhile, the built-in illumination apparatus may be built in a wall portion such as a side wall portion other than the ceiling and used.

It should be noted that the present technology may take the following configurations.

(1) A built-in illumination apparatus, including:

a light fixture unit that includes an outer contour portion to be built in a wall portion including a ceiling, and a first fitting portion; and a light source unit that includes a light source section, an additional functional section, and a second fitting portion, the light source section emitting light for illumination, the additional functional section having an additional function other than the illumination, the second fitting portion detachably fitting with the first fitting portion, the light source unit being disposed in the outer contour portion by the fitting.

(2) The built-in illumination apparatus according to (1), in which the second fitting portion includes a blade portion that detachably fits with the first fitting portion.

(3) The built-in illumination apparatus according to (2), in which the second fitting portion further includes a fitting portion body having a side peripheral surface, and the blade portion is provided on the side peripheral surface of the fitting portion body.

(4) The built-in illumination apparatus according to (2) or (3), in which the light fixture unit further includes a guide that guides the blade portion to the first fitting portion.

(5) The built-in illumination apparatus according to (4), in which the guide includes a first guide and a second guide, the first guide guiding movement of the blade portion based on movement of the light source unit, the second guide guiding rotation of the blade portion based on rotation of the light source unit, the second guide being connected to the first guide and the first fitting portion.

(6) The built-in illumination apparatus according to (5), in which the light source unit is moved in an insertion direction and inserted in the outer contour portion, and the second guide guides the blade portion from the first guide to the first fitting portion in accordance with rotation of the light source unit in a first rotation direction, and includes an inclined portion at a position connected to the first guide, the inclined portion being inclined toward the insertion direction in the first rotation direction.

(7) The built-in illumination apparatus according to (5) or (6), in which the light source unit is moved in an insertion direction and inserted in the outer contour portion, the second guide guides the blade portion from the first fitting portion to the first guide in accordance with rotation of the light source unit in a second rotation direction, the first fitting portion includes a bottom portion inclined toward the insertion direction in the second rotation direction, and the blade portion has a facing surface that faces the bottom portion when fitting with the first fitting portion, the facing surface being inclined toward the insertion direction in the second rotation direction.

(8) The built-in illumination apparatus according to any one of (1) to (7), in which the light fixture unit further includes a first terminal, and the light source unit further includes a second terminal that is to be electrically connected to the first terminal in accordance with fitting of the second fitting portion with the first fitting portion.

(9) The built-in illumination apparatus according to (8), in which at least one of the first terminal or the second terminal includes a leaf spring.

(10) The built-in illumination apparatus according to (8) or (9), in which the light source unit includes a casing having a side peripheral surface, and the second terminal is provided on the side peripheral surface.

(11) The built-in illumination apparatus according to any one of (1) to (10), in which the second fitting portion is thermally connected to the outer contour portion in accordance with fitting with the first fitting portion.

(12) The built-in illumination apparatus according to (11), in which the outer contour portion further includes a projection portion that projects toward a side of the second fitting portion, the projection portion being thermally connected to the second fitting portion.

(13) The built-in illumination apparatus according to (11) or (12), in which the light source unit further includes a heat transfer portion that transfers, to the second fitting portion, heat from a heat source including the light source section.

(14) The built-in illumination apparatus according to (13), in which the heat source includes a first heat source including the light source section, and a second heat source including a heat source other than the light source section, and the heat transfer portion includes a first heat transfer portion and a second heat transfer portion, the first heat transfer portion transferring heat of the first heat source to the second fitting portion, the second heat transfer portion transferring heat of the second heat source to the second fitting portion.

(15) The built-in illumination apparatus according to (14), in which the second fitting portion includes a first fitting member and a second fitting member separated from the first fitting member, heat from the first heat transfer portion being transferred to the first fitting member, heat from the second heat transfer portion being transferred to the second fitting member.

(16) A light source unit attachable/detachable to/from a light fixture unit that includes an outer contour portion to be built in a wall portion including a ceiling, and a first fitting portion, including:

a light source unit that includes a light source section;

an additional functional section; and a second fitting portion, the light source section emitting light for illumination, the additional functional section having an additional function other than the illumination, the second fitting portion detachably fitting with the first fitting portion, the light source unit being disposed in the outer contour portion by the fitting.

REFERENCE SIGNS LIST

10 power source unit
11 power source circuit
20 light fixture unit
21 outer contour portion
23 projection portion
30 socket portion
32 first fitting portion
34 first guide portion
35 second guide portion
36 first terminal
50 light source unit
53 second fitting portion
53*b* blade portion
54 second terminal
56 light source section
58 additional functional section
63 drive circuit
64 control circuit
65 wireless communication unit
70 heat transfer portion
71 first heat transfer portion
72 second heat transfer portion
81 first fitting member
82 second fitting member
100, 400, 500 downlight

The invention claimed is:

1. A built-in illumination apparatus, comprising:

a light fixture unit that includes:

a first terminal;

an outer contour portion configured to be built in a wall portion including a ceiling; and a socket portion that includes:

a socket portion body;

a first fitting portion on an inner peripheral surface of the socket portion body;

a first guide on the inner peripheral surface of the socket portion body; and a second guide connected to the first guide, and the first fitting portion is at a counterclockwise position in a circumferential direction relative to the second guide such that the first fitting portion is connected to the second guide; and a light source unit that includes a light source section, an additional functional section, a casing, a second terminal, and a second fitting portion, wherein the casing includes a first side peripheral surface that is extended in an insertion direction for insertion of the light source unit in the outer contour portion, the second terminal is projected outward in a radial direction from the first side peripheral surface, the second terminal is configured to electrically connect to the first terminal based on the second fitting portion that is detachably fit with the first fitting portion, the light source section is configured to emit light for illumination, the additional functional section has at least one of a sound output function, a sound collection function, or an imaging function, the second fitting portion is configured to detachably fit with the first fitting portion, the first guide and the second guide are configured to guide the second fitting portion to the first fitting portion, and the light source unit is insertable in the outer contour portion.

2. The built-in illumination apparatus according to claim 1, wherein the second fitting portion includes a blade portion configured to detachably fit with the first fitting portion.

3. The built-in illumination apparatus according to claim 2, wherein the second fitting portion further includes a fitting portion body having a second side peripheral surface, and the blade portion is on the second side peripheral surface of the fitting portion body.

4. The built-in illumination apparatus according to claim 2, wherein the first guide and the second guide are configured to guide the blade portion to the first fitting portion.

5. The built-in illumination apparatus according to claim 4, wherein the first guide is configured to guide movement of the blade portion based on movement of the light source unit, and the second guide is configured to guide rotation of the blade portion based on rotation of the light source unit.

6. The built-in illumination apparatus according to claim 5, wherein the light source unit is configured to move in the insertion direction, the second guide is further configured to guide the blade portion from the first guide to the first fitting portion based on the rotation of the light source unit in a first rotation direction, the second guide includes an inclined portion at a position connected to the first guide, and the inclined portion is inclined toward the insertion direction in the first rotation direction.

7. The built-in illumination apparatus according to claim 5, wherein the light source unit is configured to move in the insertion direction, the second guide is further configured to guide the blade portion from the first fitting portion to the first guide based on the rotation of the light source unit in a second rotation direction, the first fitting portion includes a bottom portion inclined toward the insertion direction in the second rotation direction, the blade portion includes a facing surface that faces the bottom portion in a case where the blade portion is detachably fit with the first fitting portion, and the facing surface is inclined toward the insertion direction in the second rotation direction.

8. The built-in illumination apparatus according to claim 1, wherein at least one of the first terminal or the second terminal includes a leaf spring.

9. The built-in illumination apparatus according to claim 1, wherein the second fitting portion is further configured to thermally connect to the outer contour portion based on the second fitting portion that is detachably fit with the first fitting portion.

10. The built-in illumination apparatus according to claim 9, wherein the outer contour portion includes a projection portion that projects toward a side of the second fitting portion, and the projection portion is configured to thermally connect to the second fitting portion.

11. The built-in illumination apparatus according to claim 9, wherein the light source unit further includes a heat transfer portion configured to transfer, to the second fitting portion, heat from a heat source including the light source section.

12. The built-in illumination apparatus according to claim 11, wherein the heat source includes:

a first heat source including the light source section; and a second heat source different from the light source section, the heat transfer portion includes a first heat transfer portion and a second heat transfer portion, the first heat transfer portion is configured to transfer heat of the first heat source to the second fitting portion, and the second heat transfer portion is configured to transfer heat of the second heat source to the second fitting portion.

13. The built-in illumination apparatus according to claim 12, wherein the second fitting portion includes a first fitting member and a second fitting member separated from the first fitting member, the heat of the first heat source is transferred from the first heat transfer portion to the first fitting member, and the heat of the second heat source is transferred from the second heat transfer portion to the second fitting member.

14. The built-in illumination apparatus according to claim 1, wherein the light source section is an annular light source section, and the additional functional section is at a center position of the annular light source section in the casing.

15. The built-in illumination apparatus according to claim 1, wherein the additional functional section comprises at least one of:

a temperature sensor having a temperature detection function;

a humidity sensor having a humidity detection function;

a vibration sensor having a vibration detection function; and an optical sensor having a light detection function.

16. The built-in illumination apparatus according to claim 1, wherein the additional functional section comprises at least one of:

a speaker having the sound output function;

a projector having a projection function;

a camera having the imaging function; and a microphone having the sound collection function.

17. A light source unit, comprising:

a light source section configured to emit light for illumination, wherein the light source unit is one of attachable to or detachable from a light fixture unit, the light fixture unit includes:

a first terminal;

an outer contour portion to be built in a wall portion including a ceiling; and a socket portion that includes:

a socket portion body;

a first fitting portion on an inner peripheral surface of the socket portion body;

a first guide on the inner peripheral surface of the socket portion body; and a second guide connected to the first guide, and the first fitting portion is at a counterclockwise position in a circumferential direction relative to the second guide such that the first fitting portion is connected to the second guide;

an additional functional section that has at least one of a sound output function, a sound collection function, or an imaging function;

a second fitting portion configured to detachably fit with the first fitting portion, wherein the first guide and the second guide are configured to guide the second fitting portion to the first fitting portion, and the light source unit is insertable in the outer contour portion;

a casing that includes a side peripheral surface extended in an insertion direction for insertion of the light source unit in the outer contour portion; and a second terminal that is projected outward in a radial direction from the side peripheral surface, wherein the second terminal is configured to electrically connect to the first terminal based on the second fitting portion that is detachably fit with the first fitting portion.

* * * * *